US009734688B2

(12) United States Patent
Ishii

(10) Patent No.: US 9,734,688 B2
(45) Date of Patent: Aug. 15, 2017

(54) WEARABLE DEVICE, RECORDING MEDIUM STORING CONTROL PROGRAM, AND CONTROL METHOD

(71) Applicant: KYOCERA CORPORATION, Kyoto-shi, Kyoto (JP)

(72) Inventor: Atsushi Ishii, Osaka (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 15/242,386

(22) Filed: Aug. 19, 2016

(65) Prior Publication Data

US 2016/0358446 A1 Dec. 8, 2016

(30) Foreign Application Priority Data

Feb. 21, 2014 (JP) ..... 2014-031824

(51) Int. Cl.

| | |
|---|---|
| ***G08B 21/02*** | (2006.01) |
| ***G08B 25/01*** | (2006.01) |
| *G08B 15/00* | (2006.01) |

(52) U.S. Cl.

CPC ..... *G08B 21/0286* (2013.01); *G08B 21/0211* (2013.01); *G08B 21/0269* (2013.01); *G08B 21/0283* (2013.01); *G08B 21/0288* (2013.01); *G08B 25/016* (2013.01); *G08B 15/004* (2013.01)

(58) Field of Classification Search

CPC ..... G08B 21/0286; G08B 21/0211; G08B 21/0269; G08B 21/0283; G08B 21/0288; G08B 25/016

See application file for complete search history.

(56) References Cited

U.S. PATENT DOCUMENTS

| | | | | |
|---|---|---|---|---|
| 2003/0218539 | A1* | 11/2003 | Hight | G08B 21/0244 340/539.13 |
| 2004/0025550 | A1* | 2/2004 | Yamagishi | G07C 9/00563 70/278.1 |
| 2014/0225730 | A1* | 8/2014 | DePascale | G08B 21/0288 340/539.13 |

FOREIGN PATENT DOCUMENTS

| | | | |
|---|---|---|---|
| JP | 59-072577 | U | 5/1984 |
| JP | 2000-040191 | A | 2/2000 |
| JP | 2005-316735 | A | 11/2005 |
| JP | 2006-277464 | A | 10/2006 |
| JP | 2007-249254 | A | 9/2007 |
| JP | 2007-266756 | A | 10/2007 |
| JP | 2008-186062 | A | 8/2008 |

OTHER PUBLICATIONS

Written Opinion of the International Searching Authority dated May 14, 2015 issued by the Japanese Patent Office for International Application No. PCT/JP2015/054855.

(Continued)

*Primary Examiner* — Leon Flores
(74) *Attorney, Agent, or Firm* — Procopio Cory Hargreaves and Savitch LLP

(57) ABSTRACT

A wearable device, a non-transitory computer readable recording medium that stores a control program, and a control method are disclosed. A wearable device comprises a belt and a processor. The belt is to be fastened to a body. The processor determines whether the wearable device is removed from the body. The processor notifies another device of removal of the wearable device from the body when determining the removal.

14 Claims, 23 Drawing Sheets

(56) References Cited

OTHER PUBLICATIONS

International Search Report dated Mar. 26, 2015 issued by the Japanese Patent Office for International Application No. PCT/JP2015/054855.

* cited by examiner

12

12

WEARABLE DEVICE, RECORDING MEDIUM STORING CONTROL PROGRAM, AND CONTROL METHOD

CROSS-REFERENCE TO RELATED APPLICATION

The present application is a continuation in part based on PCT Application No. PCT/JP2015/054855, filed on Feb. 20, 2015, which claims the benefit of Japanese Application No. 2014-031824, filed on Feb. 21, 2014. PCT Application No. PCT/JP2015/054855 is entitled "WEARABLE TERMINAL, CRIME PREVENTION CONTROL PROGRAM, AND CRIME PREVENTION CONTROL METHOD" and Japanese Application No. 2014-031824 is entitled "WEARABLE DEVICE, CRIME PREVENTION CONTROL PROGRAM, AND CRIME PREVENTION CONTROL METHOD." The contents of which are incorporated by reference herein in their entirety.

FIELD

Embodiments of the present disclosure relate to techniques for providing notifications.

BACKGROUND

A variety of portable crime-prevention equipment that can be worn by, for example, a child on his or her arm has been proposed.

SUMMARY

A wearable device, a non-transitory computer readable recording medium, and a control method are disclosed. In one embodiment, a wearable device comprises a belt and a processor. The belt is to be fastened to a body. The processor determines whether the wearable device is removed from the body. The processor notifies another device of removal of the wearable device from the body when determining the removal.

In one embodiment, a non-transitory computer readable recording medium is a recording medium that stores a control program. A wearable device includes a belt to be fastened to a body. The control program causes a processor of the wearable device to determine whether the wearable device is removed from the body. The control program causes the processor to notify another device of removal of the wearable device from the body when the processor determines the removal.

In one embodiment, a control method is a method employed in a wearable device including a belt to be fastened to a body. The method causes a processor of the wearable device to determine whether the wearable device is removed from the body. The method also causes the processor to notify another device of removal of the wearable device from the body when the processor determines the removal.

DETAILED DESCRIPTION

Figure 1:
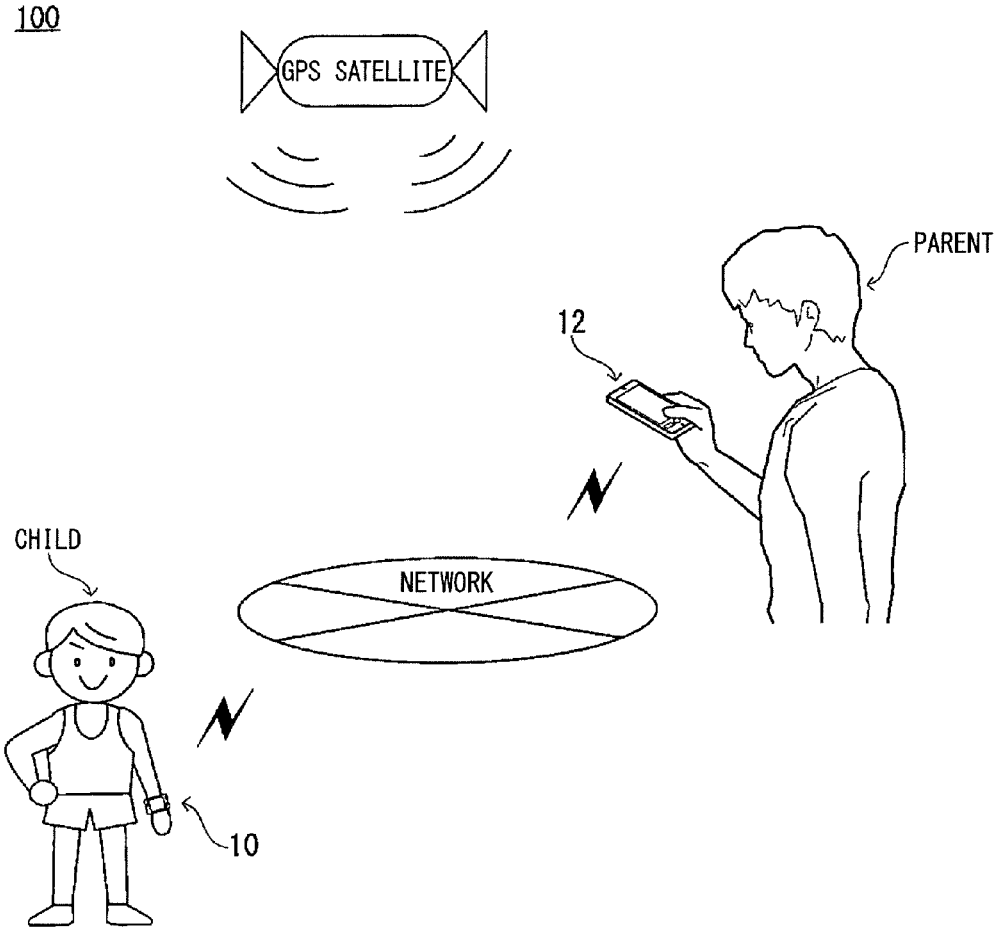
FIG. 1 illustrates a diagram showing an example of a configuration of a crime prevention system.

As illustrated in FIG. 1, a crime prevention system 100 includes a wearable terminal 10 and a mobile phone (mobile communication terminal) 12. The wearable terminal 10 and the mobile phone 12 can individually determine their positions (current positions) upon receipt of global positioning system (GPS) signals from GPS satellites. The wearable terminal 10 and the mobile phone 12 can perform voice calls and data communications with each other through a network.

The mobile phone 12 is also referred to as a first mobile terminal. In one embodiment, the mobile phone 12 is a mobile terminal that can display a map and receive input of a route for the route guidance. The mobile phone 12 can be designed to be carried by a parent, and thus may be also referred to as a parent-targeted mobile terminal.

The wearable terminal 10 is also referred to as a second mobile terminal. The wearable terminal 10 executes a warning processing in the event of removal of the wearable terminal 10 from a child. The wearable terminal 10 can be designed to be worn by a child on his or her arm (body), and thus may be also referred to as a child-targeted mobile terminal. In the crime prevention system 100, a notification of the removal of the wearable terminal 10 is provided to the mobile phone 12.

The mobile phone 12 can perform various functions such as a voice call function, an e-mail function, a GPS function, a scheduling function, a text inputting and editing function, and a calculator function. Thus, the mobile phone 12 is also referred to as a high-functionality mobile terminal. Meanwhile, it may not be required that the wearable terminal 10 be capable of performing the functions including the voice call function, the e-mail function, the text inputting and editing function, and the calculator function. It may be only required that the wearable terminal 10 at least have the GPS function and the function associated with the warning processing. Thus, the wearable terminal 10 may be also referred to as a low-functionality mobile terminal in contrast to the high-functionality mobile terminal mentioned above. In another embodiment, the mobile phone 12 and the wearable terminal 10 may have the same performance capabilities such that the mobile phone 12 and the wearable terminal 10 can perform the same functions.

Figure 2:
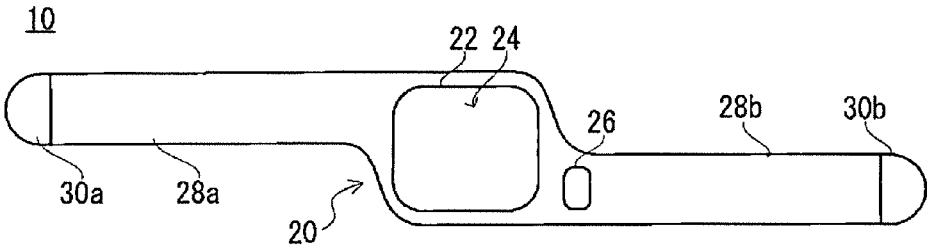
FIG. 2 illustrates an example of a front surface of a wearable terminal having a normal shape.
Figure 3:
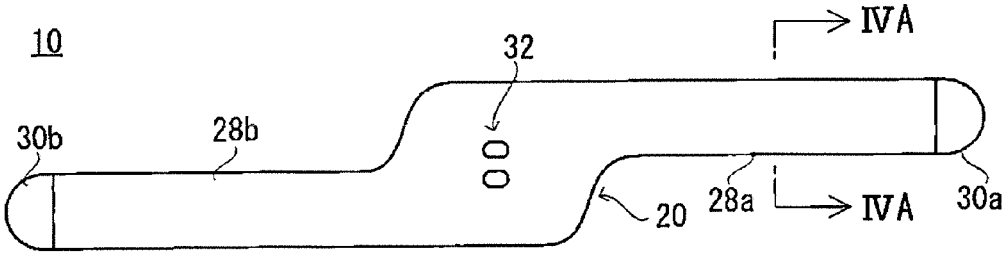
FIG. 3 illustrates an example of a rear surface of the wearable terminal having the normal shape.
Figure 4:
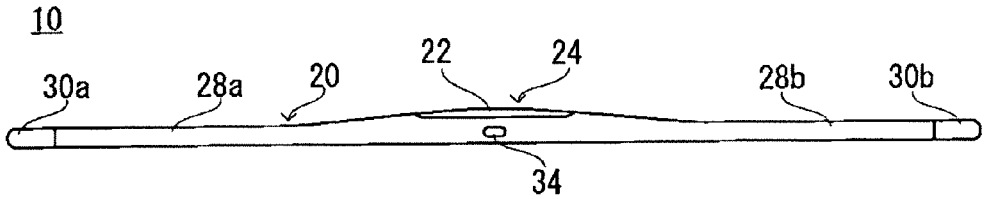
FIG. 4 illustrates an example of a left side surface of the wearable terminal having the normal shape.
Figure 5:
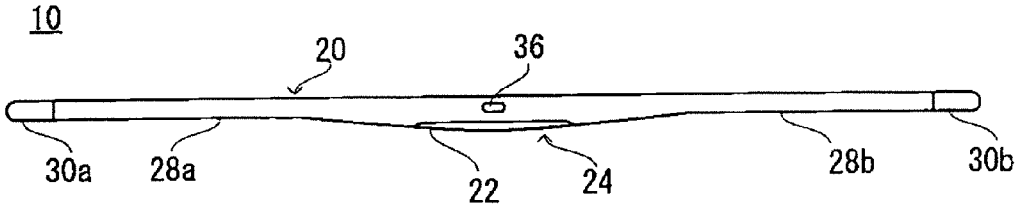
FIG. 5 illustrates an example of a right side surface of the wearable terminal having the normal shape.

FIG. 2 illustrates a front surface of the wearable terminal 10 having a normal shape. FIG. 3 illustrates a rear surface of the wearable terminal 10 having the normal shape. FIG. 4 illustrates a left side surface of the wearable terminal 10 having the normal shape. FIG. 5 illustrates a right side surface of the wearable terminal 10 having the normal shape. The "normal shape" refers to the state in which a first belt 28*a* and a second belt 28*b*, which will be described below, are straight, not bent. When the wearable terminal 10 has the normal shape, the wearable terminal 10 is not worn by the user.

As illustrated in FIGS. 2 to 5, the wearable terminal 10 includes a case 20 made of silicon resin, for example. The wearable terminal 10 in one embodiment is, for example, IPX5/7 waterproof certified.

For example, the case 20 is a wristwatch-shaped case. On the approximately central part of the front surface of the case 20 is located a display 22. The display 22 includes, for example, a liquid crystal panel or an organic EL panel. On the display 22 is located a touch panel 24. Adjacent to the display 22 is located a crime prevention key 26.

The case 20 includes the first belt 28*a* and the second belt 28*b* with the display 22 therebetween. On the tip of the first belt 28*a* is located a first LED 30*a*. On the tip of the second belt 28*b* is located a second LED 30*b*.

The first belt 28*a* and the second belt 28*b* are also simply referred to as "belts 28" unless there is a need to distinguish between them. The belts 28 are also referred to as fitting portions. Similarly, the first LED 30*a* and the second LED 30*b* are also simply referred to as "LEDs 30" unless there is a need to distinguish between them. The LEDs 30 are also referred to as light emitters.

On a rear surface of the case 20 is located a biosensor 32. On a left side surface of the case 20 is located a speaker 34. On a right side surface of the case 20 is located a microphone 36. For example, the child (user) can make necessary settings on the wearable terminal 10 through the use of the graphical user interfaces (GUIs) displayed on the display 22 and perform a voice call accordingly while his or her arm is fitted with the wearable terminal 10. In a case where the child selects a call destination displayed on the wearable terminal 10, such as a telephone number assigned to the parent-targeted mobile terminal, a voice call is started in the wearable terminal 10. A hands-free call can be performed on the wearable terminal 10. Thus, the child can catch a voice output from the speaker 34 by moving the wearable terminal 10 close to his or her face. The child can input a voice to the microphone 36. When the child performs an operation on a call end GUI that is displayed on the display 22 during the voice call, the voice call is ended. The setting of the hands-free operation can be changed such that the child can perform a voice call without the need for moving the wearable terminal 10 close to his or her face.

In response to a press on the crime prevention key 26, the wearable terminal 10 is set to a crime prevention mode (specified state). When the wearable terminal 10 in the crime prevention mode is removed from the child's arm, the wearable terminal 10 executes the warning processing. In response to the execution of the warning processing, the display 22 may display an image indicating danger and the speaker 34 may output a warning sound (buzzer sound). The LEDs 30 on the tips of the belts 28 may emit light in a warning color (such as red).

Figure 6:
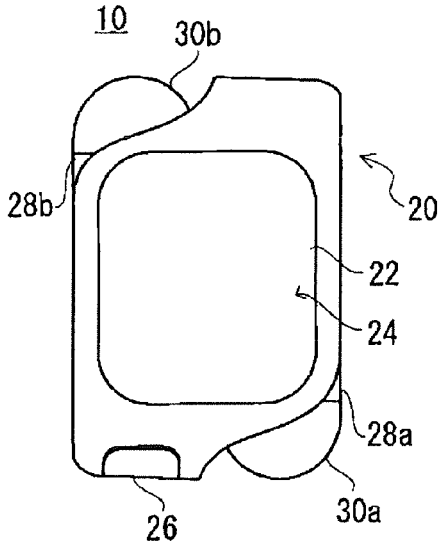
FIG. 6 illustrates a front side of the wearable terminal having a fitted shape.
Figure 7:
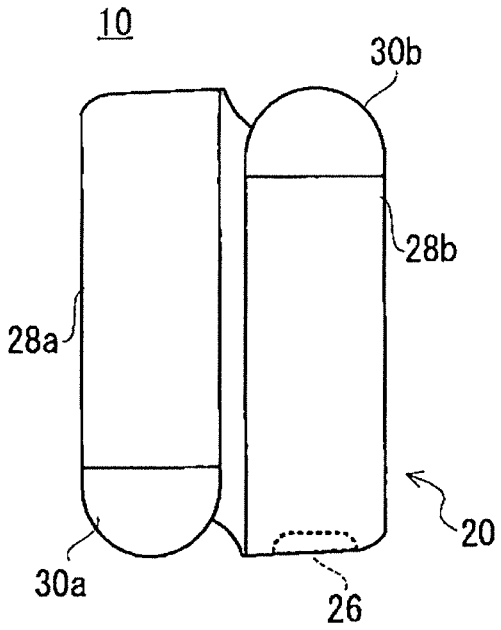
FIG. 7 illustrates a rear side of the wearable terminal having the fitted shape.
Figure 8:
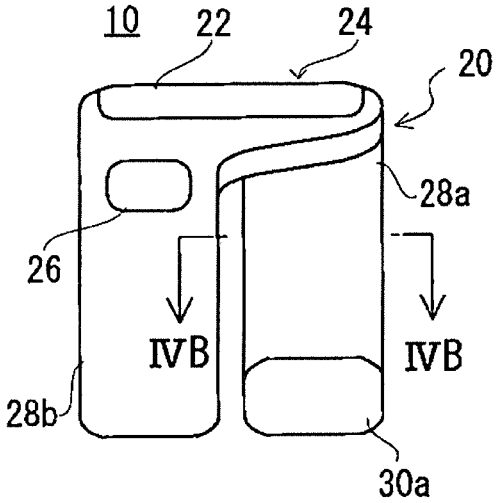
FIG. 8 illustrates a side surface of the wearable terminal having the fitted shape.
Figure 9:
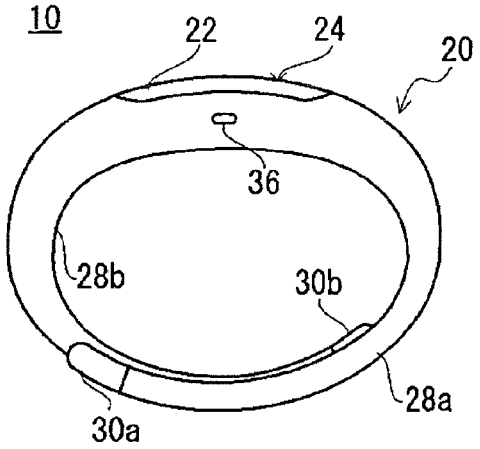
FIG. 9 illustrates another side surface of the wearable terminal having the fitted shape.
Figure 10:
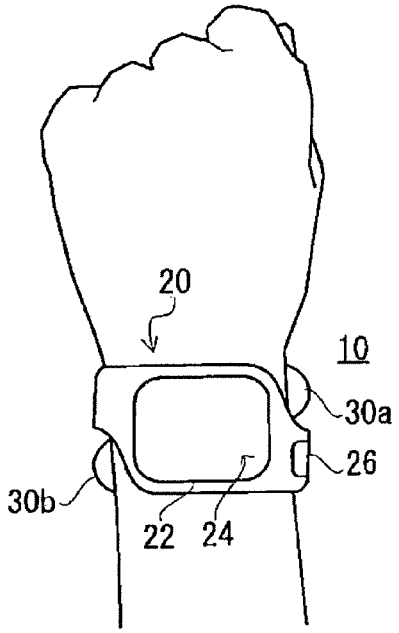
FIG. 10 illustrates an example of the state in which the wearable terminal is worn.

FIGS. 6 to 10 each illustrate an example of a shape (hereinafter referred to as a fitted shape) of the wearable terminal 10 in the state of being worn. FIG. 6 illustrates a front side of the wearable terminal 10 having the fitted shape. FIG. 7 illustrates a rear side of the wearable terminal 10 having the fitted shape. FIG. 8 illustrates a side surface of the wearable terminal 10 having the fitted shape. FIG. 9 illustrates another side surface of the wearable terminal 10 having the fitted shape. FIG. 10 illustrates an example of the state in which the wearable terminal 10 is worn.

As illustrated in FIGS. 6 to 9, the first belt 28*a* and the second belt 28*b* of the wearable terminal 10 having the fitted shape do not overlap each other and are bent to the rear side of the wearable terminal 10. The wearable terminal 10 has a ring shape when the wearable terminal 10 having the fitted shape is viewed from another side surface (see FIG. 9). In the state where the wearable terminal 10 is worn on an arm, the wearable terminal 10 having the ring shape is wrapped around the arm.

Figure 11:
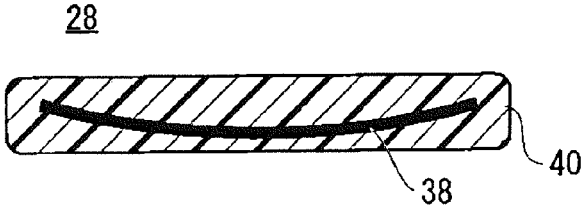
FIG. 11 illustrates an example of a cross section taken along the line IV A-IV A in FIG. 3.
Figure 12:
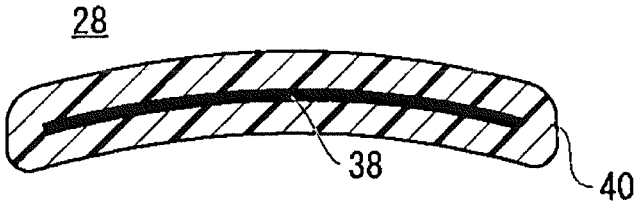
FIG. 12 illustrates an example of a cross section taken along the line IV B-IV B in FIG. 8.

FIG. 11 illustrates an example of a cross section taken along the line IV A-IV A in FIG. 3. FIG. 12 illustrates an example of a cross section taken along the line IV B-IV B in FIG. 8. As illustrated in FIGS. 11 and 12, the first belt 28*a* and the second belt 28*b* include plates 38 made of metal and extending from approximately tip portions to the base portions of the respective belts. The plates 38 are surrounded by and covered with silicon resin 40. The first belt 28*a* and the second belt 28*b* can keep their respective normal shapes and fitted shapes owning to the plates 38, which are also called stainless steel spring wires.

In particular, as illustrated in FIG. 11, the cross section of the plate 38 is bent to the rear side of the case 20 in the normal shape. The plate 38 in this state as a whole keeps an approximately flat shape, and thus each of the first belt 28*a* and the second belt 28*b* can keep the normal shape illustrated in, for example, FIG. 3.

Meanwhile, as illustrated in FIG. 12, in the fitted shape, the central portion of the cross section of the plate 38 is bent to the front side of the case 20, or equivalently, in a direction opposite to the direction in FIG. 11. The plate 38 in this state keeps a shape bent to the inner side (the rear side of the case 20), and thus each of the first belt 28*a* and the second belt 28*b* can keep the fitted shape illustrated in, for example, FIG. 8.

When forces with which the plate 38 is bent to the rear side of the case 20 is exerted on the plate 38 in the state illustrated in FIG. 11, the plate 38 changes its shape as illustrated in FIG. 12. This means that the shape of the plate 38 is changed from an approximately flat shape to a curved shape. The shape of each of the first belt 28*a* and the second belt 28*b* is changed from the normal shape to the fitted shape accordingly. The plate 38 in the curved state has forces acting thereon to keep the curved state. Even if the first belt 28*a* and the second belt 28*b* each having the fitted shape are stretched toward the front side of the case 20, the plates 38 cause the respective belts to recover the shapes illustrated in FIG. 9. In a case where forces are exerted on the plate 38 in the state illustrated in FIG. 12 such that the plate 38 becomes approximately flat, the shape of the cross section of the plate 38 can be changed to the shape illustrated in FIG. 11.

Thus, the wearable terminal 10 can be worn by a child on his or her arm without the need for fastening together the first belt 28*a* and the second belt 28*b* each having the fitted shape. In particular, the curved plates 38 have forces acting thereon to keep their respective shapes, so that the wearable terminal 10 can be stably worn by a child on his or her arm regardless of the size of the arm. The case 20 is made of the silicon resin 40 having a higher coefficient of friction. Once being worn on an arm, the wearable terminal 10 having this configuration is less likely to slip down from the arm. In another embodiment, the first belt 28*a* and the second belt 28*b* of the wearable terminal 10 may be fastened to each other through a mechanical component such as a fastening member. In still another embodiment, it is not required that the first belt 28*a* and the second belt 28*b* each having the fitted shape overlap each other, and further the tip of the first belt 28*a* and the tip of the second belt 28*b* may have a gap therebetween. This means that the wearable terminal 10 having the fitted shape in the still another embodiment has a ring shape as a whole, and particularly has a partially open ring shape.

Figure 13:
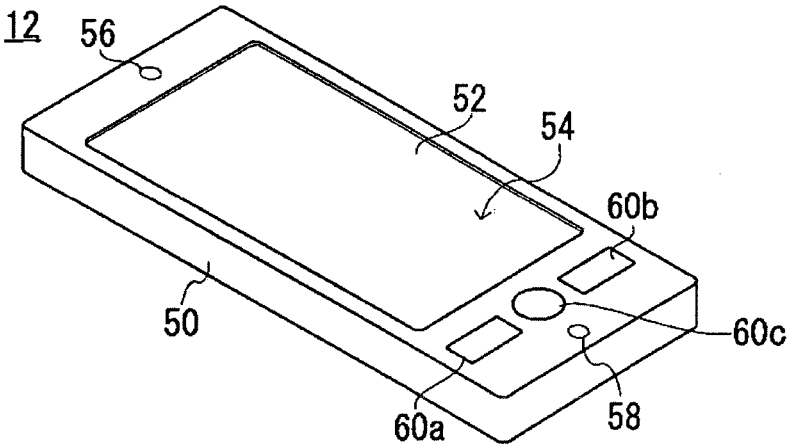
FIG. 13 illustrates an example of an external view of a mobile phone.

As illustrated in FIG. 13, the mobile phone 12 is, for example, a smartphone. The mobile phone 12 includes a housing 50 having a vertically-oriented flat rectangular shape, for example. The mobile phone 12 may be any mobile terminal such as a tablet terminal, a tablet personal computer (PC), a notebook PC, or a personal digital assistant (PDA).

On a main surface (front surface) of the housing 50 is located a display 52. The display 52 includes, for example, a liquid crystal panel or an organic electroluminescent (EL) panel. On the display 52 can be located a touch panel 54.

On the main surface of the housing, at one vertical end of the housing 50 is located a speaker 56. On the main surface of the housing, at another vertical end of the housing 50 is located a microphone 58.

On the main surface of the housing 50 are included in a plurality of hard keys. Along with the touch panel 54, the plurality of hard keys provide input operation means. In one embodiment, the plurality of hard keys include a call key 60*a*, a call end key 60*b*, and a menu key 60*c*. The call key 60*a*, the call end key 60*b*, and the menu key 60*c* are hereinafter referred to as "hard keys 60" unless there is a need to distinguish between them.

In response to a touch operation performed on a dial pad displayed on the display 52, a telephone number is input to the mobile phone 12. Then, in response to an operation performed on the call key 60*a*, a voice call is started in the mobile phone 12. The voice call is ended in the mobile phone 12 in response to an operation performed on the call end key 60*b*. The power of the mobile phone 12 can be turned on or off in response to a long press on the call end key 60*b*.

In response to an operation on the menu key 60*c*, a home screen is displayed on the display 52. In this state, the parent can perform touch operations on, for example, an object displayed on the display 52 to select the object and confirm the selection. The touch panel 54 can detect the touch operations.

The mobile phone 12 can perform a map function of displaying a map including the current position, the e-mail function, and a browser function in addition to the telephone function. The GUIs, such as keys and icons displayed on the display 52, are also correctively referred to as objects in the following description.

Figure 14:
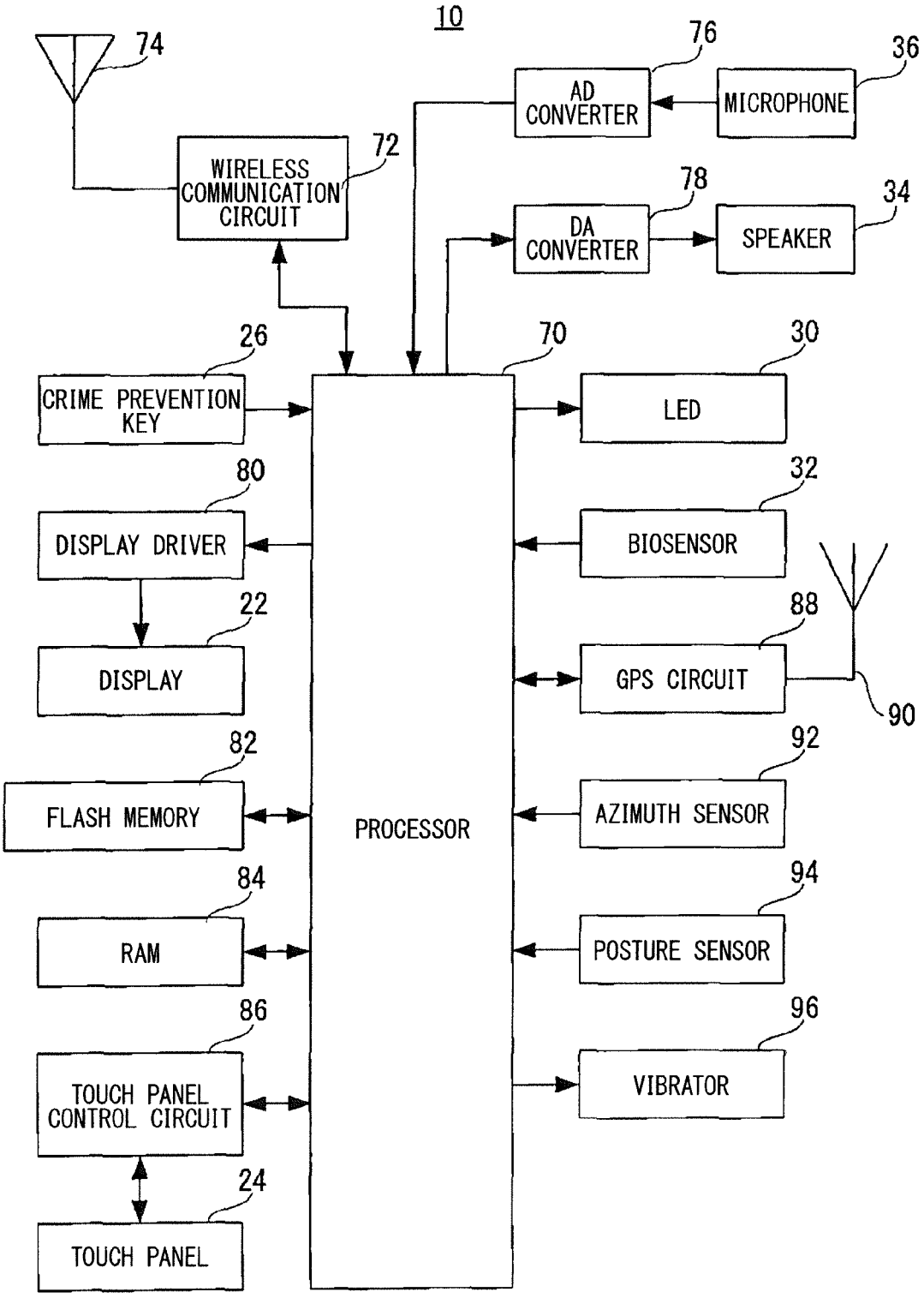
FIG. 14 illustrates a diagram showing an example of an electrical configuration of the wearable terminal.

As illustrated in FIG. 14, the wearable terminal 10 according to one embodiment illustrated in FIG. 1 includes a processor 70 called a computer or a CPU. The processor 70 is connected with, for example, the crime prevention key 26, the LEDs 30, the biosensor 32, a wireless communication circuit 72, an analog-to-digital (AD) converter 76, a digital-to-analog (DA) converter 78, a display driver 80, a flash memory 82, a RAM 84, a touch panel control circuit 86, a GPS circuit 88, an azimuth sensor 92, a posture sensor 94, and a vibrator 96. The wireless communication circuit 72 is connected with an antenna 74. The display driver 80 is connected with the display 22. The touch panel control circuit 86 is connected with the touch panel 24. The GPS circuit 88 is connected with a GPS antenna 90.

The processor 70 can perform overall control over the wearable terminal 10. When coming into use, all or part of the program preset in the flash memory 82 is expanded in the RAM 84. The processor 70 can operate in accordance with the program in the RAM 84. The RAM 84 can be also used as a work area or a buffer area of the processor 70. The RAM 84 is also referred to as a memory.

In accordance with various embodiments, the processor 70 may be implemented as a single integrated circuit (IC) or as multiple communicatively coupled ICs and/or discrete circuits. It is appreciated that the processor 70 can be implemented in accordance with various known technologies.

In one embodiment, the processor 70 includes one or more circuits or units configurable to perform one or more data computing procedures or processes by executing instructions stored in an associated memory, for example. In other embodiments, the processor 70 may be implemented as firmware (e.g. discrete logic components) configured to perform one or more data computing procedures or processes.

In accordance with various embodiments, the processor 70 may include one or more processors, controllers, microprocessors, microcontrollers, application specific integrated circuits (ASICs), digital signal processors, programmable logic devices, field programmable gate arrays, or any combination of these devices or structures, or other known devices and structures, to perform the functions described herein.

The crime prevention key 26 may be a hard key including a fingerprint sensor. The fingerprint sensor included in the crime prevention key 26 is an area sensor that can read a fingerprint when the whole finger is pressed against the sensor. The fingerprint sensor employs an electric field method in reading a fingerprint. In the electric field method, an electric field is generated between the sensor and the inside (dermis) of a finger, and then fingerprint ridges and valleys are read on the basis of the strength of the electric field. When a finger is pressed against a sensor surface of the fingerprint sensor, the fingerprint sensor reads the fingerprint of the finger as fingerprint information. Information including hard key information (key data) received by the crime prevention key 26 and the read fingerprint information is input to the processor 70. In some cases, the processor 70 executes a fingerprint authentication processing of checking whether the read fingerprint agrees with the registered fingerprint.

The fingerprint sensor may employ, for example, a capacitive sensing method, an optical method, a thermal-sensitive method, or a pressure-sensitive method instead of the electric field method. The fingerprint sensor may be a sweep sensor including a sensor surface that can capture sweeping of a finger. Since the fingerprint authentication processing involves common techniques, the detailed description thereof is not given here for brevity.

The wireless communication circuit 72 is a circuit to transmit and receive, through the antenna 74, radio waves for voice calls and e-mails. In one embodiment, the wireless communication circuit 72 is a circuit to perform wireless communications based on the code division multiple access (CDMA) system. For example, when an operation of selecting a telephone number directory entry is performed on the wearable terminal 10, the wireless communication circuit 72 can execute, in accordance with the instructions from the processor 70, an outgoing voice call processing to output an outgoing voice call signal through the antenna 74. The outgoing voice call signal is transmitted to, for example, the mobile phone 12 through the base station and the communication network. For example, when the incoming voice call processing is performed in the wearable terminal 10, the communicable state in which the wearable terminal 10 can communicate with the mobile phone 12 is established, and then the processor 70 executes the voice call processing. In this state, the child can communicate with the parent through the speaker 34 and the microphone 36.

When the antenna 74 receives an outgoing voice call signal transmitted by the mobile phone 12, the wireless communication circuit 72 can notify the processor 70 of an incoming call, and then the processor 70 can execute the incoming call processing accordingly. For example, when the incoming call processing is executed in the wearable terminal 10, the speaker 34 outputs ringtones and the vibrator 96, which will be described below, causes the wearable terminal 10 to vibrate. When the incoming voice call operation is performed on the wearable terminal 10, the communicable state in which the wearable terminal 10 can communicate with, for example, the mobile phone 12 is established, and then the processor 70 executes the voice call processing.

The display 22 displays GUIs for operating the wearable terminal 10. The GUIs are operated through the touch panel 24. For example, with the GUI for performing an outgoing call operation being displayed, when the child performs an outgoing call operation using the touch panel 24, an outgoing voice call signal is output as described above.

The AD converter 76 is connected with the microphone 36 illustrated in FIG. 5. A voice signal from the microphone 36 is converted into digital voice data by the AD converter 76 and is input to the processor 70. The DA converter 78 is connected with the speaker 34. The DA converter 78 can convert the digital voice data into a voice signal and provide the voice signal to the speaker 34 through an amplifier. Thus, the speaker 34 can output a voice based on the voice data. During the execution of the telephone communication processing, voices collected by the microphone 36 are transmitted to the telephone at the other end of the connection and voices collected in the telephone at the other end of the connection are output from the speaker 34.

The display driver 80 is connected with the display 22 illustrated in FIG. 2. The display 22 can display a video or an image in accordance with video data or image data output from the processor 70. The display driver 80 includes a video memory that can temporarily store the image data displayed on the display 22. The video memory can store data output from the processor 70. The display driver 80 can cause the display 22 to display an image in accordance with the contents of the video memory. That is, the display driver 80 can control the display of the display 22 connected with the display driver 80 in accordance with the instructions from the processor 70. Thus, the processor 70 is also referred to as a display controller. On the display 22 may include a backlight. The display driver 80 can control the brightness and turning on and off of the backlight in accordance with the instructions from the processor 70.

The touch panel control circuit 86 is connected with the touch panel 24. The touch panel control circuit 86 can supply the touch panel 24 with, for example, a needed voltage. The touch panel control circuit 86 can input, to the processor 70, a touch start signal indicating the start of a touch on the touch panel 24, an end signal indicating the end of the touch, and coordinate data indicating a touch position being the target position of the touch. The processor 70 can determine, on the basis of the coordinate data, which object is touched.

In one embodiment, the touch panel 24 is a capacitive touch panel that can detect changes in capacitance generated between the surface of the touch panel 24 and an object such as a finger (hereinafter referred to as a "finger" for convenience). The touch panel 24 can detect that the touch panel 24 is touched by, for example, one finger or a plurality of fingers. Thus, the touch panel 24 is also referred to as a pointing device. The touch panel control circuit 86 can output, to the processor 70, the coordinate data indicating the position of the touch operation within the touch valid range of the touch panel 24. When a touch operation is performed on the surface of the touch panel 24, the position of the operation, the direction of the operation, and the like are input to the wearable terminal 10.

The wearable terminal 10 may include a non-transitory recording medium that can be read by the processor 70 other than the flash memory 82 and the RAM 84. The wearable terminal 10 may include, for example, a hard disk drive, a solid state drive (SSD), and a universal serial bus (USB) memory.

Examples of touch operations according to one embodiment include a tap operation, a long tap operation, a flick operation, and a slide operation.

The tap operation refers to an operation of bringing a finger into contact (touch) with the surface of the touch panel 24 and then moving (releasing) the finger off the surface of the touch panel 24 in a short period of time. The long tap operation refers to an operation of keeping a finger in contact with the surface of the touch panel 24 and then moving the finger off the surface of the touch panel 24. The flick operation refers to an operation of bringing a finger into contact with the surface of the touch panel 24 and then causing the finger to flip in a desired direction at a speed equal to or greater than a predetermined speed. The slide operation refers to an operation of moving a finger in a desired direction while keeping the finger in contact with the surface of the touch panel 24 and then moving the finger off the surface of the touch panel 24.

The above-mentioned slide operation includes the so-called drag operation, which is a slide operation of bringing a finger into contact with an object displayed on the surface of the display 22 and moving the object. The operation of moving a finger off the surface of the touch panel 24 after the drag operation is referred to as a drop operation.

The word "operation" may be hereinafter omitted from the phrases including the tap operation, the long tap operation, the flick operation, the slide operation, the drag operation, and the drop operation. It is not required that the touch operation be performed with a finger of the user. Alternatively, the touch operation may be performed with, for example, a stylus pen.

The LEDs 30 can emit light in a plurality of colors, such as red, blue, and green. The processor 70 controls, for example, the color of emission light and the cycle of flashing. As described above, the LEDs 30 emit red light when the warning processing is executed.

The biosensor 32 is a sensor for measuring a pulse of a person (such as a child) who wears the wearable terminal 10. The processor 70 determines, through the use of the output from the biosensor 32, whether the wearable terminal 10 is worn by the child. While the biosensor 32 measures the child's pulse, the processor 70 determines that the wearable terminal 10 is worn by the child. While the biosensor 32 does not measure the child's pulse, the processor 70 determines that the wearable terminal 10 is not worn by the child. The biosensor 32 is also referred to as a detector.

The GPS circuit 88 is activated in determining the current position of the wearable terminal 10. Upon receipt of input of a GPS satellite signal received by the GPS antenna 90, the GPS circuit 88 can execute a positioning processing in accordance with the GPS signal. The GPS circuit 88 can compute the longitude, the latitude, and the altitude (elevation) as GPS information (position information) accordingly.

Although FIG. 1 illustrates a single GPS satellite for simplicity, the three-dimensional positioning associated with the current position requires GPS signals received from four or more GPS satellites. As long as GPS signals from three GPS satellites, instead of GPS signals from four or more GPS satellites, are received, the longitude and the latitude can be computed through the two-dimensional positioning. The current position determined by the wearable terminal 10 is also referred to as a terminal position.

The azimuth sensor 92, which is also referred to as an electromagnetic compass or a direction output unit, includes three geomagnetic sensors and a control circuit. The control circuit extracts geomagnetic data from magnetic data detected by the three geomagnetic sensors, and then outputs the geomagnetic data to the processor 70. The processor 70 computes the azimuth angle (azimuth or direction) data with reference to geomagnetic data output from the control circuit and causes the buffer of the RAM 84 to store the data as the direction of the wearable terminal 10. In one embodiment, the azimuth is given in degrees counting clockwise, with 0 degrees at north (N), 90 degrees at east (E), 180 degrees at south (S), and 270 degrees at west (W). Each geomagnetic sensor includes a hall element. Alternatively, each geomagnetic sensor may include a magnet-resistive (MR) element or a magnet-impedance (MI) element.

The posture sensor 94 is used to detect the movement of the wearable terminal 10. The posture sensor 94 is, for example, a piezoelectric gyroscope. The piezoelectric gyroscope can detect angular velocities around three axes (X, Y, and Z axes) and output the detection results to the processor 70. The processor 70 detects the movement and the inclination of the wearable terminal 10 on the basis of the angular velocities around the individual axes detected by the posture sensor 94.

For example, the processor 70 determines, in accordance with the posture detected by the posture sensor 94, whether the child is checking the wearable terminal 10. While the child is checking the wearable terminal 10, the processor 70 detects, by using the azimuth sensor 92, the azimuth the child faces, namely, the heading direction of the child. The wearable terminal 10 transmits, to the mobile phone 12, terminal position information including the current position (terminal position), the posture, and the azimuth.

The vibrator 96 is a motor including an eccentric load mounted on the rotation axis. The turning on and off of the vibrator 96 is controlled by the processor 70. When the vibrator 96 is activated (turned on), vibrations of the vibrator 96 cause the wearable terminal 10 to vibrate.

Figure 15:
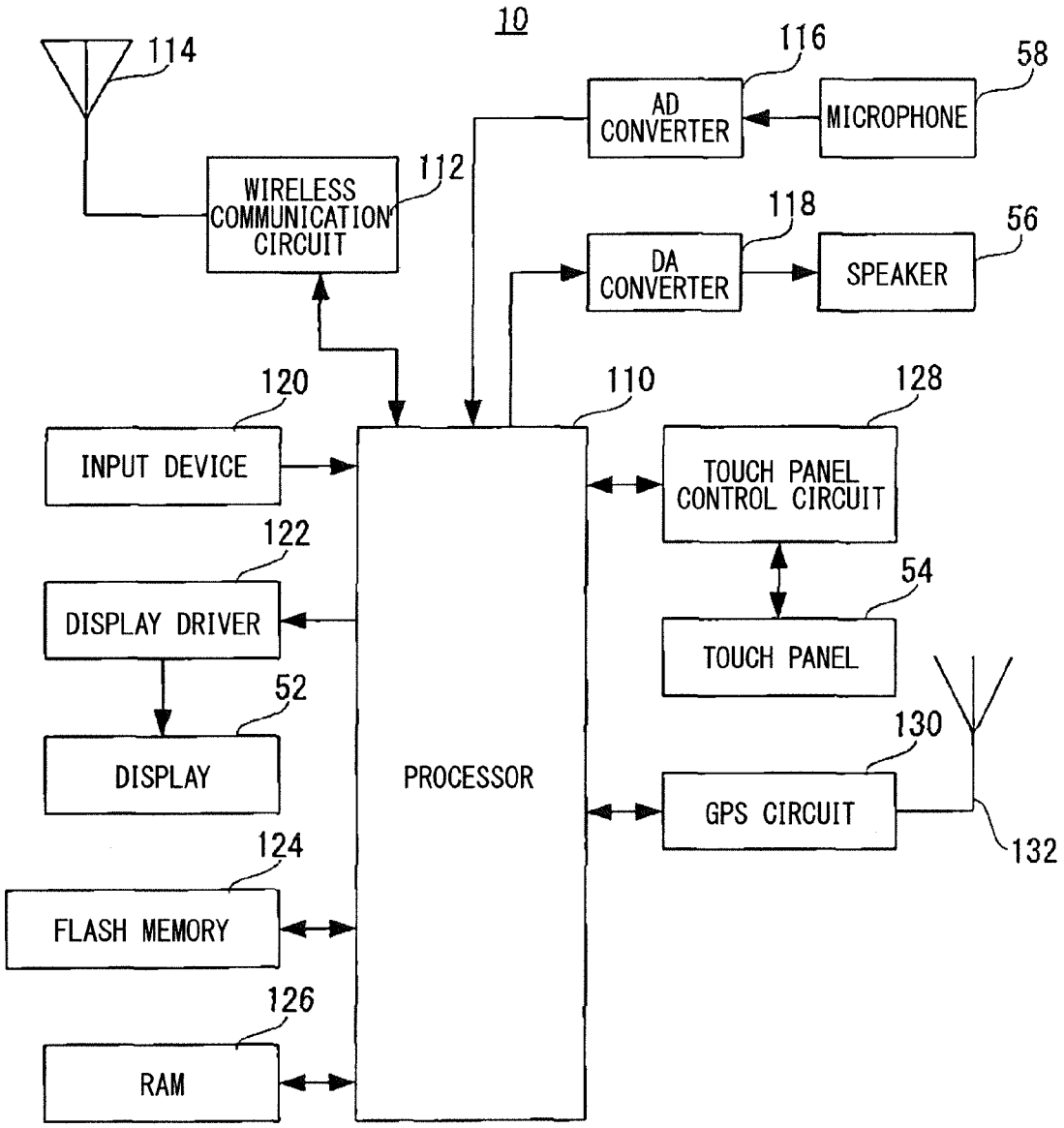
FIG. 15 illustrates a diagram showing an example of an electrical configuration of the mobile phone.

As illustrated in FIG. 15, the mobile phone 12 includes a processor 110 called a computer or a CPU. The processor 110 is connected with, for example, a wireless communication circuit 112, an AD converter 116, a DA converter 118, an input device 120, a display driver 122, a flash memory 124, a RAM 126, a touch panel control circuit 128, and a GPS circuit 130.

The wireless communication circuit 112 is connected with an antenna 114. The display driver 122 is connected with the display 52. The touch panel control circuit 128 is connected with the touch panel 54. The GPS circuit 130 is connected with a GPS antenna 132. The AD converter 116, the DA converter 118, the display driver 122, the flash memory 124, the RAM 126, the touch panel control circuit 128, and the GPS circuit 130 are substantially the same as the corresponding components of the wearable terminal 10, and thus the same description will not be repeated for simplicity.

The processor 110 can perform overall control over the mobile phone 12 to perform functions including the voice call function and the data communication function.

In accordance with various embodiments, the processor 110 may be implemented as a single integrated circuit (IC) or as multiple communicatively coupled ICs and/or discrete circuits. It is appreciated that the processor 110 can be implemented in accordance with various known technologies.

In one embodiment, the processor 110 includes one or more circuits or units configurable to perform one or more data computing procedures or processes by executing instructions stored in an associated memory, for example. In other embodiments, the processor 110 may be implemented as firmware (e.g. discrete logic components) configured to perform one or more data computing procedures or processes.

In accordance with various embodiments, the processor 110 may include one or more processors, controllers, microprocessors, microcontrollers, application specific integrated circuits (ASICs), digital signal processors, programmable logic devices, field programmable gate arrays, or any combination of these devices or structures, or other known devices and structures, to perform the functions described herein.

The input device 120 includes the hard keys 60 illustrated in FIG. 13. Thus, the input device 120 forms an operation acceptor that can accept key operations performed on the hard keys 60. The hard key information (key data) accepted by the operation acceptor is input to the processor 110.

The wireless communication circuit 112, which is substantially the same as the wireless communication circuit 72 of the wearable terminal 10, can perform wireless communications based on the CDMA system.

For example, in accordance with outgoing call (outgoing voice call) operation accepted by the touch panel 54, the wireless communication circuit 112 can execute, in accordance with the instructions from the processor 110, an outgoing voice call processing to output an outgoing voice call signal through the antenna 114. The outgoing voice call signal is transmitted to the telephone at the other end of the connection through the base station and the communication network. When the telephone at the other end of the connection performs an incoming voice call processing, the communicable state is established, and the processor 110 can execute a telephone communication processing accordingly.

The wireless communication circuit 112 is wirelessly connected with a network (such as a communication network or a telephone network) through the antenna 114. The mobile phone 12 can establish data communications with the wearable terminal 10 through the network accordingly.

The RAM 126 can store map data. In some cases, the mobile phone 12 causes the display 52 to display a map corresponding to the current position on the basis of the GPS information computed by the GPS circuit 130.

The crime prevention mode will be described in detail. As described above, in response to a press on the crime prevention key 26, the crime prevention mode is set in the wearable terminal 10. When it is determined, through the use of the biosensor 32, that the wearable terminal 10 in the crime prevention mode is removed from the child's arm, the wearable terminal 10 executes the warning processing. As described above, the wearable terminal 10 executing the warning processing may cause the display 22 to display an image indicating danger and may cause the speaker 34 to output a warning sound. The LEDs 30 on the tips of the individual belts 28 may emit light in a warning color. The wearable terminal 10 determines the current position and provides, to the mobile phone 12, a notification of the current position of the wearable terminal 10 and a notification of the removal of the wearable terminal 10 from the child's arm.

Thus, the wearable terminal 10 can alert people around the child to the dangers posed to the child and notify, for example, the parent of the child wearing the wearable terminal 10 that the child is in danger. In particular, the parent can be notified of the place in which the wearable terminal 10 is removed from the child. This can offer the parent a clue as to what is going on with the child and help the parent to decide how to react.

The warning is expected to be helpful in repelling a malicious stranger hanging around the child. The LEDs 30 emit light in a warning color in response to the warning. This makes the wearable terminal 10 more conspicuous. If the stranger snatches the wearable terminal away from the child and throws it away, the discarded wearable terminal can be found more easily.

In one embodiment, the child can set or release the crime prevention mode by performing an operation on the crime prevention key 26. Thus, the child can set the crime prevention mode at any time. If the child is at home and thus is in no need of the wearable terminal 10, the child can release the crime prevention mode to take off the wearable terminal 10. In one embodiment, unless the crime prevention mode is set, the removal of the wearable terminal 10 is not determined. This means that the wearable terminal having the crime prevention mode can prevent a false alarm. In another embodiment, without having the crime prevention mode, the wearable terminal 10 may be configured to provide notification in the event of the removal of the wearable terminal 10 from the child.

The warning processing can be terminated in response to an operation on the crime prevention key 26. The operation of terminating the warning processing may not be accepted in the event of a fingerprint authentication failure. That is, the warning processing is not terminated unless an operation is performed on the crime prevention key 26 with the finger that matches with the registered fingerprint. This configuration can prevent a stranger from terminating the warning. In another configuration, the fingerprint authentication processing may also be executed in releasing the crime prevention mode.

In another embodiment, the warning processing may be executed in response to a long press on the crime prevention key 26 regardless of whether the crime prevention mode is set. That is, in a case where the crime prevention mode is not set, the parent of the child and the people around the child can be notified that the child is in danger. When sensing danger, the child may take off the wearable terminal 10 in which the crime prevention mode is set. The warning processing may also be executed in response to a long press on the crime prevention key 26 while the wearable terminal 10 is not worn.

In another embodiment, the warning processing may be terminated using a password, a GPS signal (position), or a release signal in place of fingerprints.

In a case where the crime prevention mode is not set and the biosensor 32 fails to detect the biological information, the child is likely to have fallen down due to, for example, a sickness. In one embodiment, an emergency alarm is provided in the event of a biological information detection failure while the crime prevention mode is not set.

Figure 17:
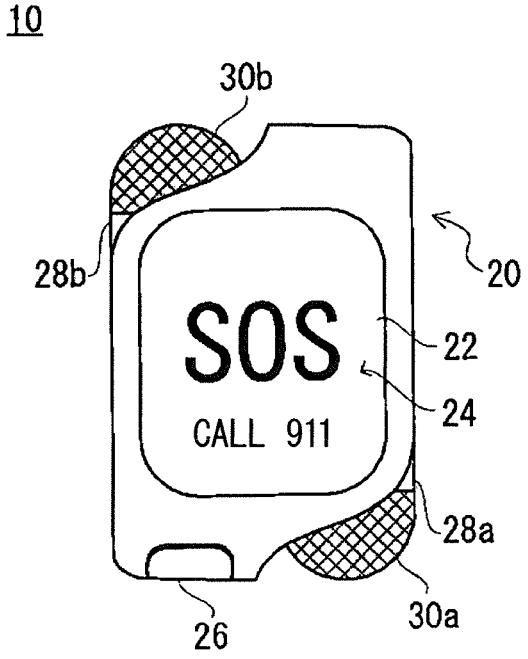
FIG. 17 is a diagram showing an example of the state in which the wearable terminal executes an alarm processing.

As illustrated in FIG. 17, the wearable terminal 10 providing an emergency alarm causes the display 22 to display a warning that the child is in the state of emergency, an emergency telephone number, and the like. The speaker 34 outputs a voice notifying the people around the child of the emergency state, and the LEDs 30 emit red light. Then, the current position is detected, and a notification of the current position and a notification that the emergency alarm is issued are provided to the mobile phone 12.

In place of the child, the wearable terminal 10 can seek help from people around the child in the event of an emergency. If an operation is performed on the crime prevention key 26 during the emergency alarm, the alarm can be terminated.

The mobile phone 12 may include a non-transitory recording medium that can be read by the processor 110 other than the flash memory 124 and the RAM 126. The mobile phone 12 may include, for example, a hard disk drive, an SSD, and a USB memory.

Figure 18:
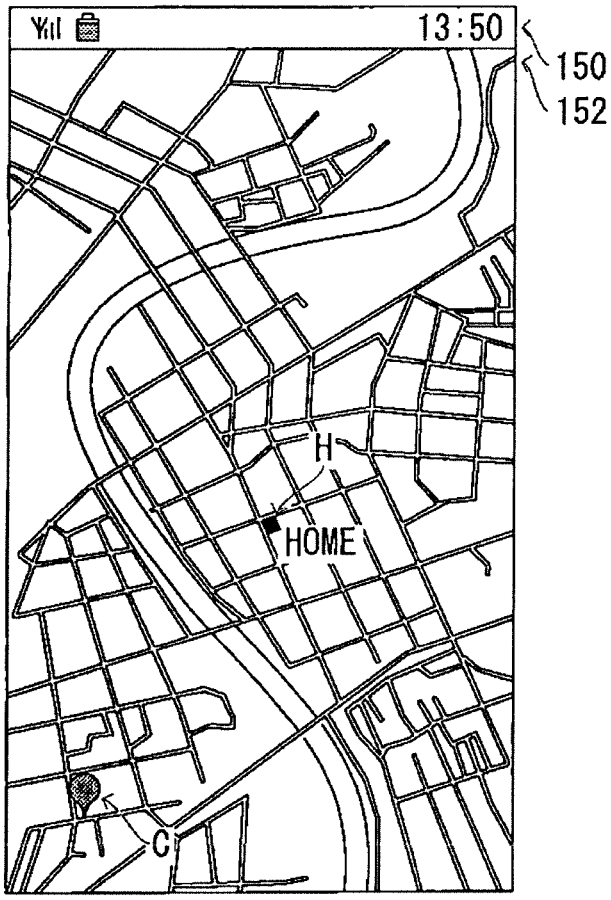
FIG. 18 illustrates a diagram showing an example of the state in which a map is displayed on a display.

FIG. 18 illustrates an example of a map displayed by the display 52 of the mobile phone 12. As illustrated in FIG. 18, the display range of the display 52 includes a state display area 150 and a function display area 152. In the state display area 150 are displayed a pictogram indicating the radio wave reception condition at the antenna 114, a pictogram indicating the remaining battery life of the secondary battery, and a time of day. In the function display area 152 is displayed a map. On the map are displayed a home position icon H indicating a registered home position (hereinafter referred to as a "home position") and a terminal position icon C indicating the terminal position received from the wearable terminal 10. For example, when the parent causes the mobile phone 12 to perform the function (hereinafter referred to as a "management function") of managing the wearable terminal 10, map data including the home position and the current position of the child (the terminal position of the wearable terminal 10) is read from the RAM 126, and then a map including the above-mentioned information is displayed on the display 52.

With the map being displayed, when a route to home (destination) is input to the mobile phone 12 (parent-targeted mobile terminal), the route guidance is provided on the wearable terminal 10.

Figure 19:
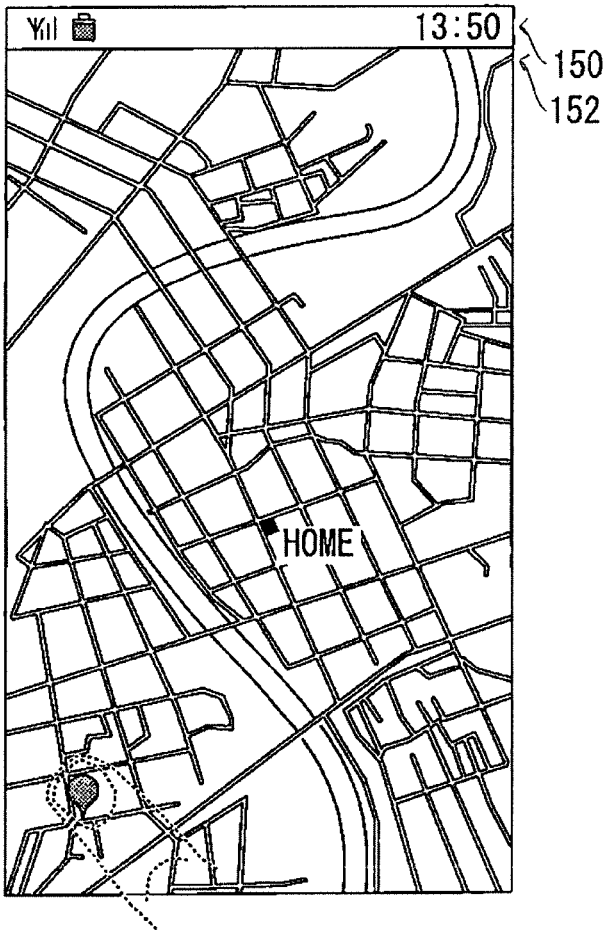
FIG. 19 illustrates the state in which a tap is performed on a terminal position icon.
Figure 20:
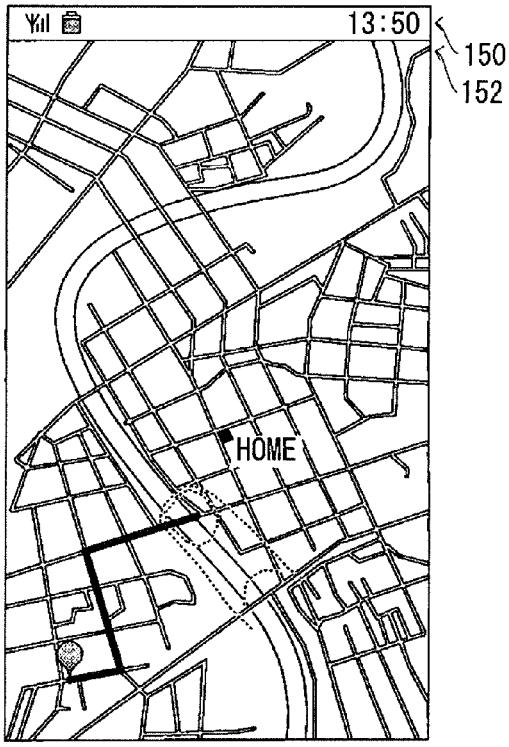
FIG. 20 illustrates an example of the state in which a route is input.
Figure 21:
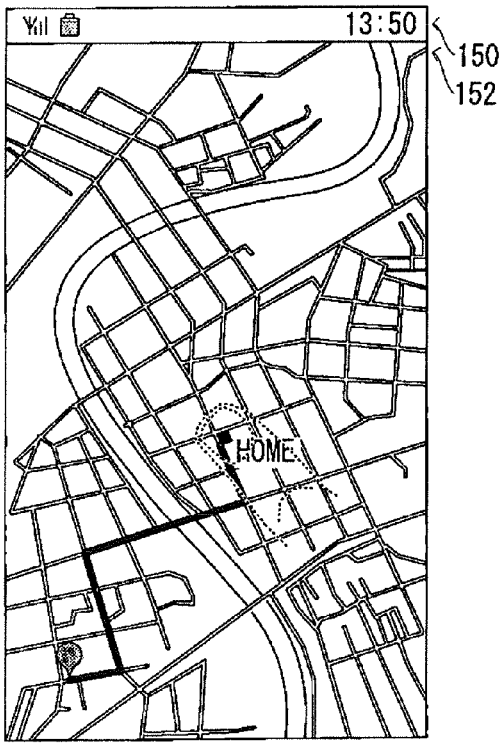
FIG. 21 illustrates another example of the state in which the route is input.
Figure 22:
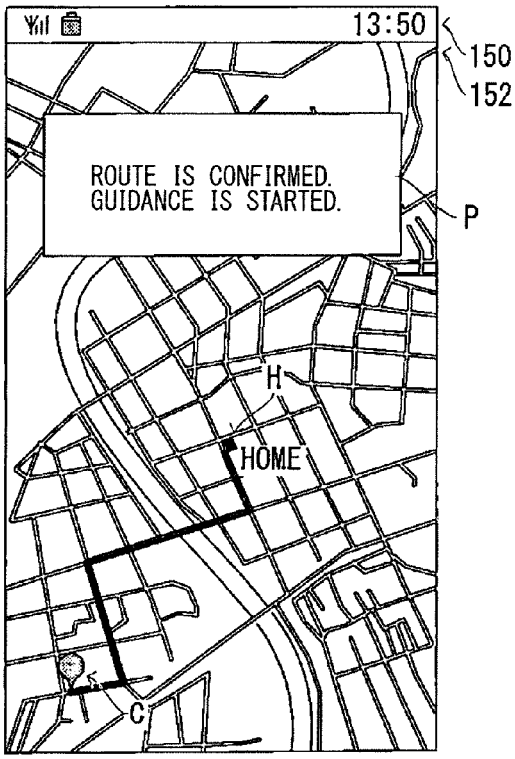
FIG. 22 illustrates an example of the state in which the input route is confirmed.

With reference to FIGS. 19 to 22, description will be given on an operation of inputting a route. As illustrated in FIG. 19, when the parent performs a tap on the terminal position icon C indicating the position of the wearable terminal 10, the mobile phone 12 becomes ready to receive input of a route. The parent performs a slide to input a route from the terminal position icon C to the home position icon H in this state as illustrated in FIG. 20, and then performs a tap on the home position icon H as illustrated in FIG. 21 to complete the inputting of the route to the mobile phone 12. When the parent completes the inputting of the route to the mobile phone 12, the display 52 displays, as illustrated in FIG. 22, a pop-up P conveying a message that the input route is confirmed and that the route guidance associated with the route is started. At this time, the mobile phone 12 creates guidance information including a message that the route guidance is provided. When the guidance information is transmitted to the wearable terminal 10, the display 22 displays the message that the route guidance is provided. The wearable terminal 10 activates the vibrator 96.

After a lapse of time with no operation being performed on the mobile phone 12 in the state of being ready to receive input of a route, this state of being ready to receive input of a route is released (canceled).

Figure 23:
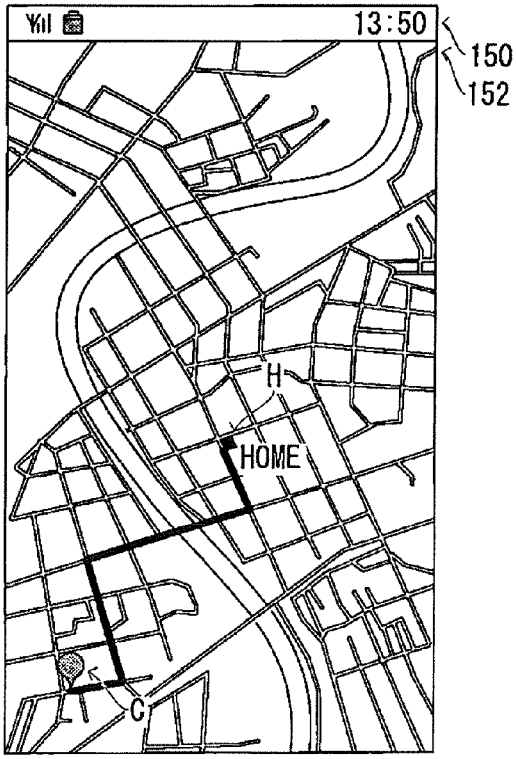
FIG. 23 illustrates an example of the state in which route guidance is started.
Figure 23:
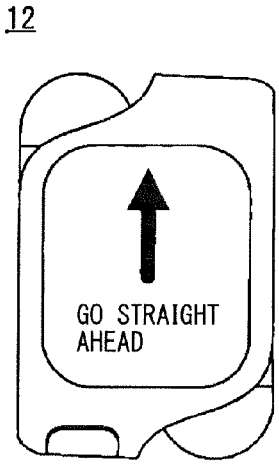

Next, description will be given on actions during the route guidance. Firstly, the mobile phone 12 reads the terminal position and the azimuth (the orientation of the child) from the terminal position information transmitted from the wearable terminal 10, and creates guidance information indicating which direction the child should head into. If the orientation of the child agrees with the heading direction of the child on the route, the guidance information including a message and an icon for advising the child to keep going is created. When the wearable terminal 10 receives the guidance information, the display 22 of the wearable terminal 10 displays the message and the icon for advising the child to keep going (see FIG. 23).

Figure 24:
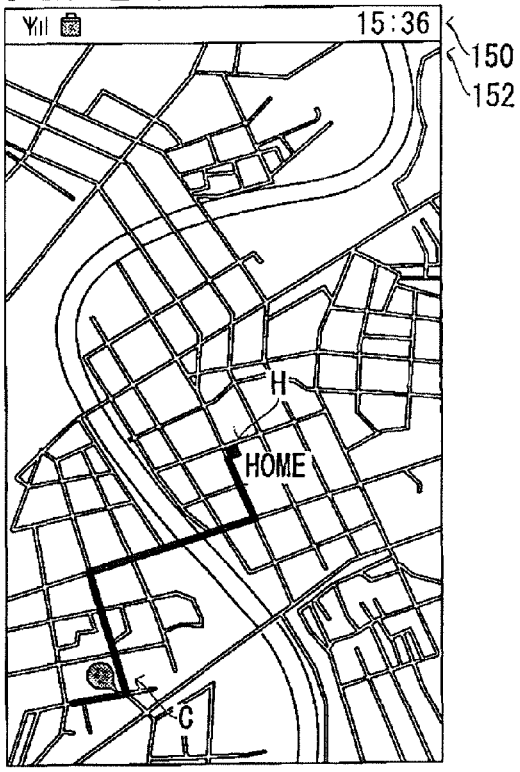
FIG. 24 illustrates an example of the state in which the route guidance is provided.
Figure 24:
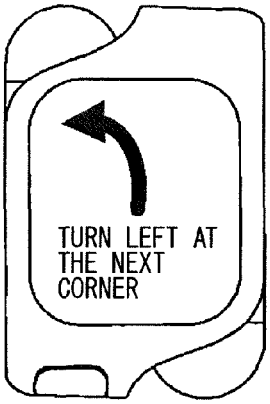

Then, guidance information is created in the mobile phone 12 every time the terminal position information is changed. The created guidance information is transmitted to the wearable terminal 10. As illustrated in FIG. 24, the position of the terminal position icon C on the display 52 of the mobile phone 12 is updated corresponding to the child's position that has changed in accordance with, for example, the route guidance. When the child wearing the wearable terminal 10 approaches a branch point, such as an intersection, the mobile phone 12 creates the guidance information indicating the path the child should follow. In a case where the path turns left with respect to the orientation of the child, the mobile phone 12 creates guidance information including a message advising the child to turn left at the branch point and an icon indicating the left. The display 22 of the wearable terminal 10 that has received the guidance information displays the message advising the child to turn left with respect to the heading direction of the child and the icon indicating the left (see FIG. 24).

Figure 25:
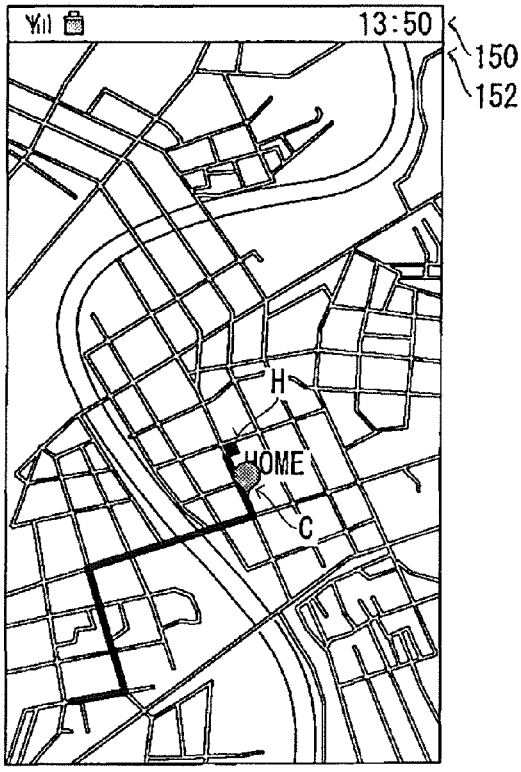
FIG. 25 illustrates another example of the state in which the route guidance is provided.
Figure 25:
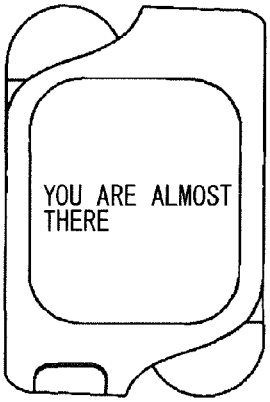

As illustrated in FIG. 25, in a case where the terminal position of the wearable terminal 10 moves close to the home position, the mobile phone 12 creates the guidance information notifying that the child is in close proximity to home. When the wearable terminal 10 receives the guidance information, the display 22 of the wearable terminal 10 displays a message that the child is in close proximity to home.

Figure 26:
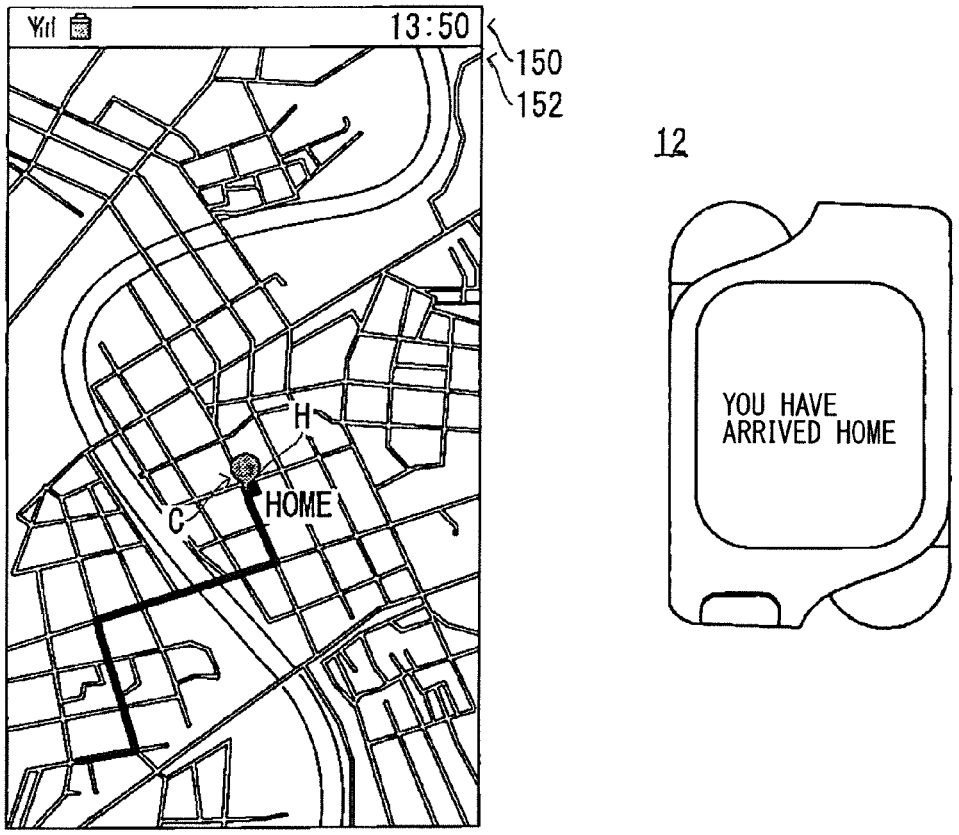
FIG. 26 illustrates an example of the state in which the route guidance is ended.

As illustrated in FIG. 26, when the mobile phone 12 determines that the wearable terminal 10 (the child) has arrived home on the basis of the terminal position and the home position, the mobile phone 12 transmits, to the wearable terminal 10, arrival information notifying that the child has arrived home. When the wearable terminal 10 receives the arrival information, the display 22 of the wearable terminal 10 displays a message that the child has arrived home.

As described above, the appropriate route guidance can be easily provided in accordance with the position of the child. The child can head toward the destination by following the route guidance.

In one embodiment, in a case where the child strays from the route during the route guidance, the mobile phone 12 may transmit setting information to set the wearable terminal 10 to the crime prevention mode. Upon receipt of the setting information, the wearable terminal 10 sets itself to the crime prevention mode. That is, the crime prevention mode can be automatically set if the child steps in an insecure place, in which the child is more likely to be exposed to a danger.

If the child's return to the route is confirmed, the mobile phone 12 may transmit release information to the wearable terminal 10. Upon receipt of the release information, the wearable terminal 10 releases the crime prevention mode.

The crime prevention mode may be set in a case where the child goes beyond a secure area set by the parent in advance. The secure area may be an area extending for a predetermined distance from home. If this is the case, a determination can be made whether the child is found in the secure area with reference to the center of the secure area and the size (the distance from the center) of the secure area without necessitating the map data. The wearable terminal 10 may set itself to the crime prevention mode in accordance with its own judgement, or the wearable terminal 10 may set itself to the crime prevention mode in accordance with instructions from the mobile phone 12.

The crime prevention mode of the wearable terminal 10 may be set or released by the parent regardless of the current position of the child.

In another embodiment, the speaker 34 may output the contents of the guidance information while the route guidance is provided on the wearable terminal 10. That is, the route guidance may be provided by voices output from the speaker 34 with no use of the display on the display 22.

In still another embodiment, a route may be changed while the route guidance is provided on the wearable terminal 10. The parent may register a dangerous place or a dangerous road as a security alert zone. With respect to any place, location information indicating the state of the area around the relevant place may be registered.

The above description has provided an overview of the features of one embodiment. The features will be described below in detail with reference to the memory map of the RAM 84 of the wearable terminal 10 in FIG. 27, the memory map of the RAM 126 of the mobile phone 12 in FIG. 28, and flowcharts in FIGS. 29 to 35.

Figure 27:
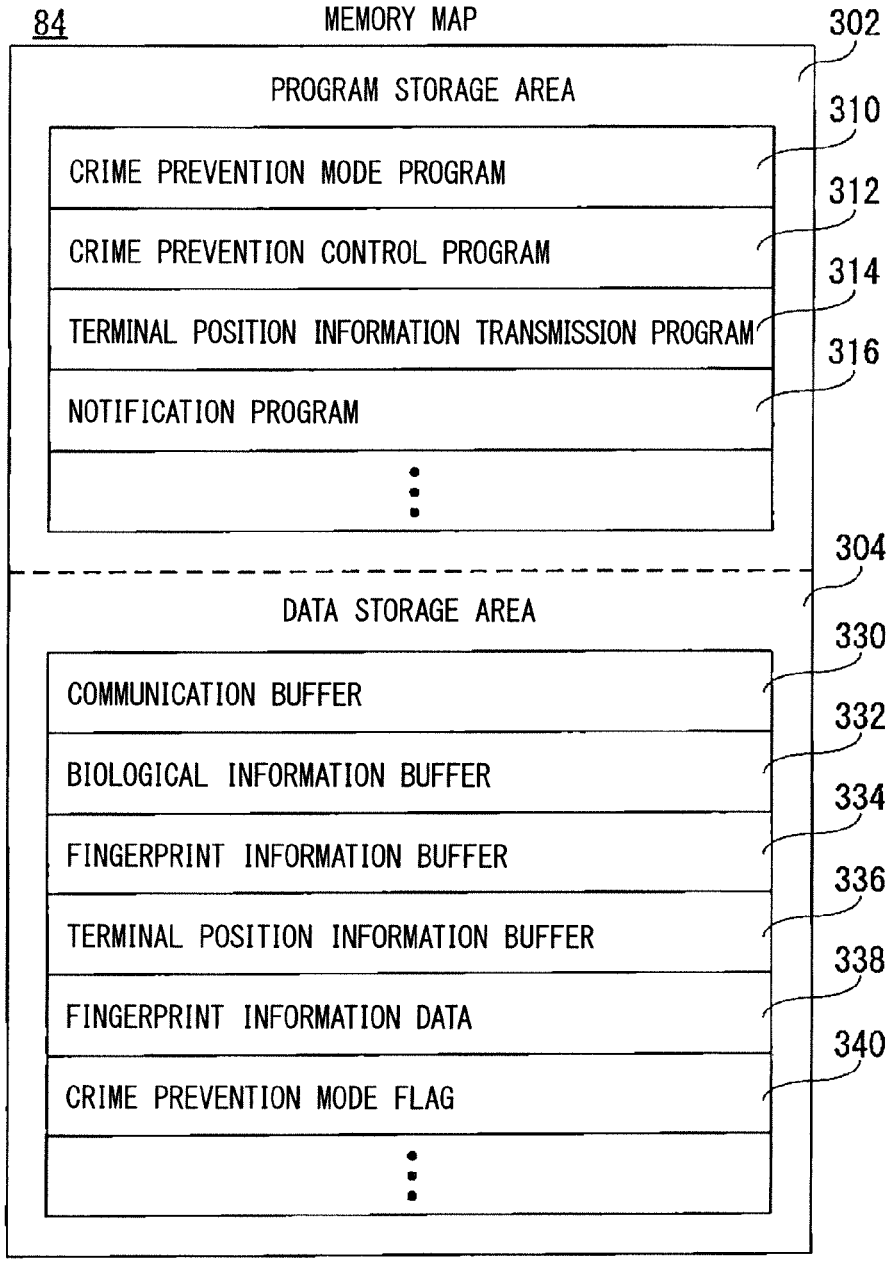
FIG. 27 illustrates a diagram showing an example of a memory map of a random-access memory (RAM) of the wearable terminal.

As illustrated in FIG. 27, the RAM 84 of the wearable terminal 10 includes a program storage area 302 and a data storage area 304 formed therein. The program storage area 302 is the area for storing (expanding) all or part of the program data preset in the flash memory 82 (see FIG. 14).

In the program storage area 302 are stored a crime prevention mode program 310 for setting and releasing the crime prevention mode, a crime prevention control program 312 for executing and terminating the warning processing and the alarm processing, a terminal position information transmission program 314 for transmitting the terminal position information to the mobile phone 12, a notification program 316 for providing a notification of information transmitted from the mobile phone 12, and the like.

In the data storage area 304 of the RAM 84 are provided a communication buffer 330, a biological information buffer 332, a fingerprint information buffer 334, a terminal position information buffer 336, and the like. Furthermore, fingerprint information data 338 and the like are stored in the data storage area 304. A crime prevention mode flag 340 and the like are also provided in the data storage area 304.

In the communication buffer 330, information received by the wearable terminal 10 from the mobile phone 12, such as the setting information, the release information, and the guidance information, is temporarily stored. In the biological information buffer 332, the biological information detected by the biosensor 32 is temporarily stored. In the fingerprint information buffer 334, the fingerprint information read by the fingerprint sensor included in the crime prevention key 26 is temporarily stored. In the terminal position information buffer 336, the terminal position information including the current position determined by the wearable terminal 10, the posture of the wearable terminal 10, and the detected azimuth is temporarily stored.

The fingerprint information data 338 includes the fingerprint information registered in advance. When the fingerprint authentication processing is executed in the wearable terminal 10, the processor 70 reads the fingerprint information included in the fingerprint information data 338 and the fingerprint information stored in the fingerprint information buffer 334.

The crime prevention mode flag 340 is the flag for determining whether the crime prevention mode is set. The crime prevention mode flag 340 includes, for example, a 1-bit register. If the crime prevention mode flag 340 is on (set), the data value "1" is placed in the register. If the crime prevention mode flag 340 is turned off (cleared), the data value "0" is placed in the register. The crime prevention mode flag 340 is toggled on and off in accordance with the processing in the crime prevention mode program 310. In the initial state, the crime prevention mode flag 340 is turned off, in other words, the crime prevention mode is released.

Furthermore, in the data storage area 304, address book data including contact information is stored, and another flag and a timer (counter) required in execution of the programs are provided.

Figure 28:
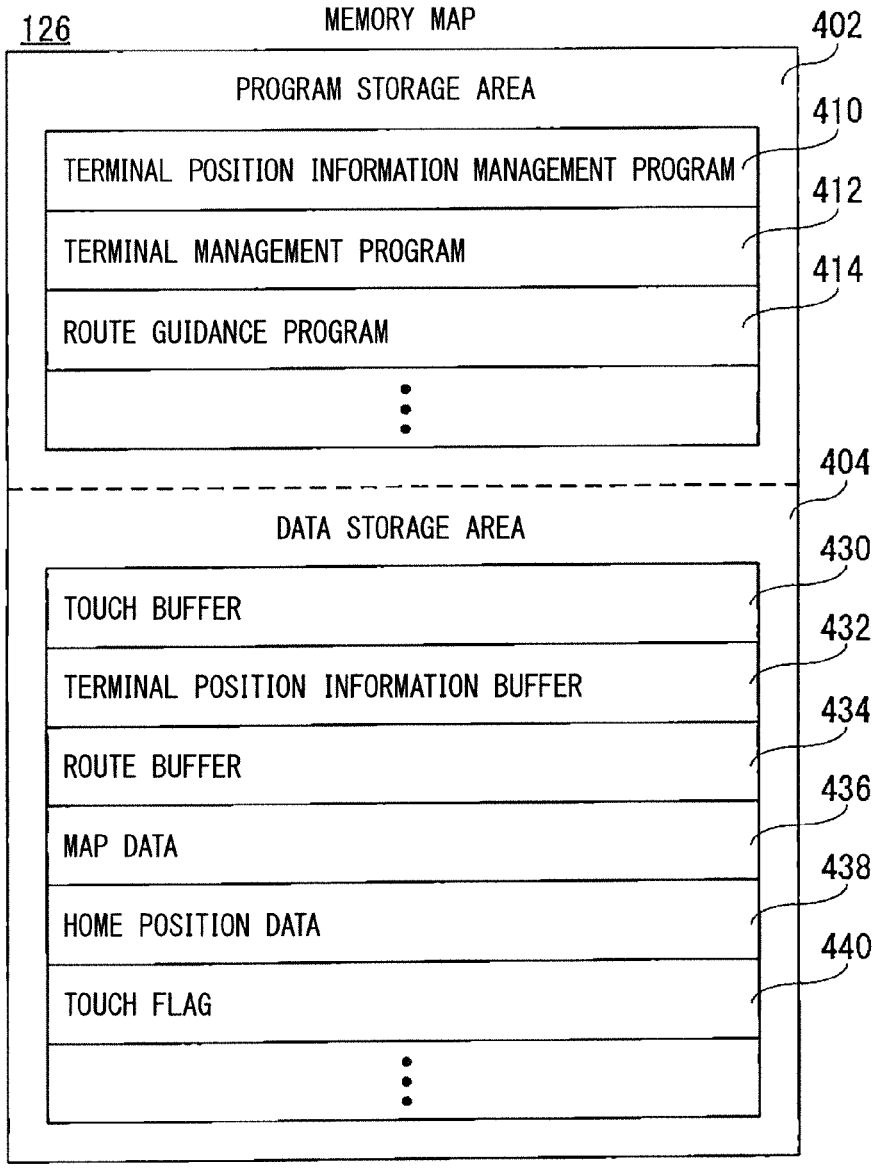
FIG. 28 illustrates a diagram showing an example of a memory map of a RAM of the mobile phone

As illustrated in FIG. 28, the RAM 126 of the mobile phone 12 includes a program storage area 402 and a data storage area 404 formed therein. As described above, the program storage area 402 is the area for storing (expanding) all or part of the program data preset in the flash memory 124 (see FIG. 15).

In the program storage area 402 are stored a terminal position information management program 410 for receiving and storing the terminal position information transmitted by the wearable terminal 10, a terminal management program 412 for controlling the route guidance and the displaying of a map, a route guidance program 414 for providing the route guidance on the wearable terminal 10, and the like. Furthermore, programs for performing the functions, such as the e-mail function and the browser function, are also stored in the program storage area 402.

In the data storage area 404 of the RAM 126 are provided a touch buffer 430, a terminal position information buffer 432, a route buffer 434, and the like. Furthermore, map data 436, home position data 438, and the like are stored in the data storage area 404. A touch flag 440 and the like are also provided in the data storage area 404.

In the touch buffer 430, data including the data on touch coordinates output by the touch panel control circuit 128 and the data on touch coordinates of the starting point and the endpoint of a touch operation is temporarily stored. The received terminal position information is temporarily stored in the terminal position information buffer 432. The input route is temporarily stored in the route buffer 434.

The map data 436 is the data on a map displayed during the route guidance and the registration of information. The home position data 438 is the data indicating the position of the registered home.

The touch flag 440 is the flag for determining whether the touch panel 24 is touched. The touch flag 440 is toggled on and off in accordance with the output from the touch panel control circuit 128.

In the data storage area 404, the data for displaying an object such as a GUI is stored, and another flag and a timer (counter) required in execution of the programs are provided.

The processor 70 of the wearable terminal 10 performs a plurality of tasks in parallel under control by a predetermined OS, namely, an OS based on Linux® such as Android® or iOS®. The plurality of tasks include a crime prevention mode processing in FIG. 29, a crime prevention control processing in FIG. 30, a terminal position information transmission processing in FIG. 31, and a notification processing in FIG. 32.

Figure 29:
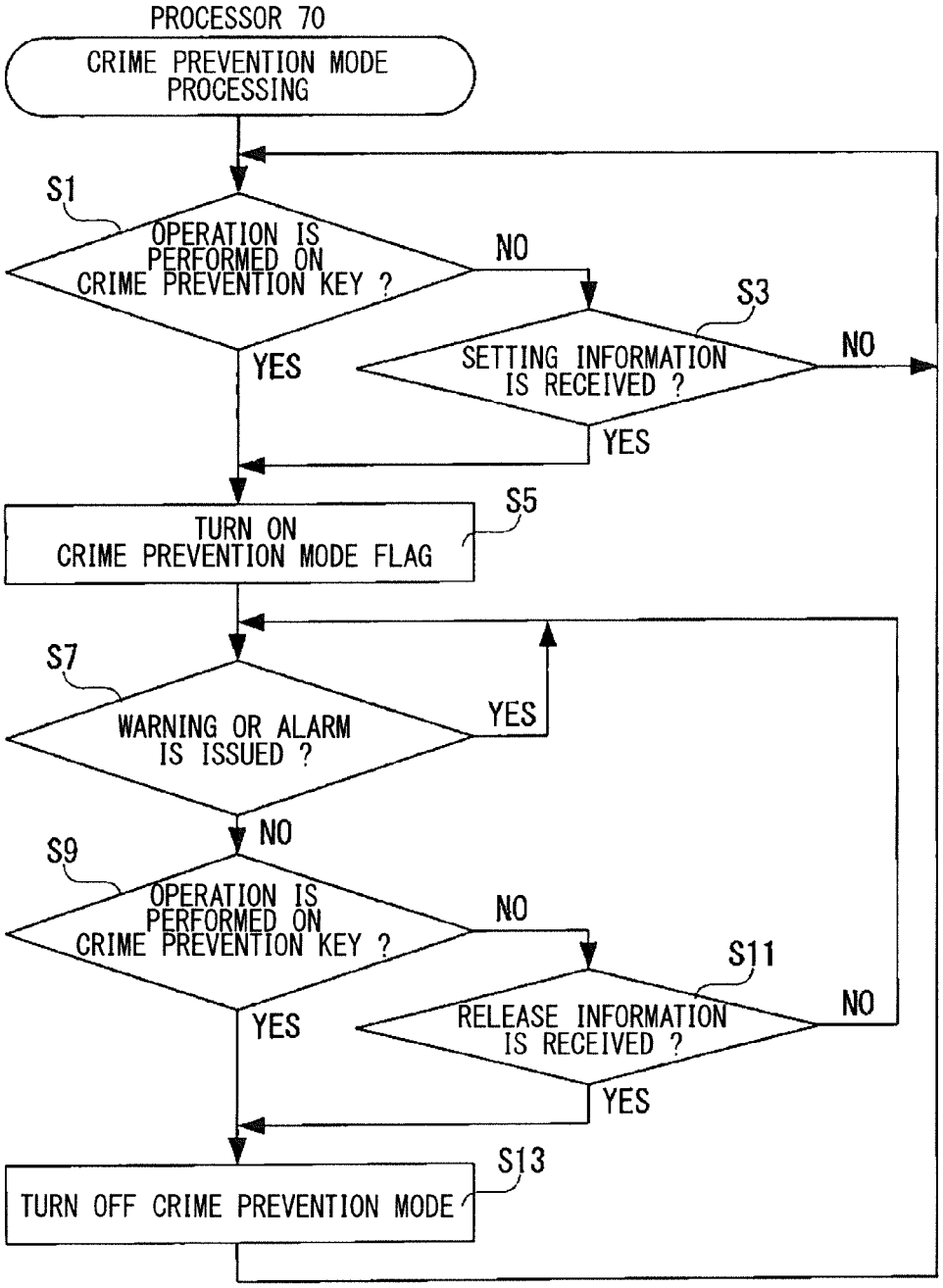
FIG. 29 illustrates a flowchart showing an example of a crime prevention mode processing performed by a processor of the wearable terminal.

FIG. 29 illustrates a flowchart showing the crime prevention mode processing. For example, the crime prevention mode processing is executed when the power of the wearable terminal 10 is turned on. In Step S1, the processor 70 determines whether an operation is performed on the crime prevention key 26. That is, a determination is made whether the operation of setting the crime prevention mode is performed. If "YES" in Step S1, or equivalently, if an operation is performed on the crime prevention key 26, the processor 70 proceeds to the processing in Step S5. If "NO" in Step S1, or equivalently, if an operation is not performed on the crime prevention key 26, the processor 70 determines, in Step S3, whether setting information is received. That is, a determination is made whether the setting information transmitted from the mobile phone 12 is stored in the communication buffer 330. The processor 70 executing the processing in Step S3 functions as a place determination unit. If "NO" in Step S3, or equivalently, if the setting information is not received, the processor 70 returns to the processing in Step S1. If "YES" in Step S3, or equivalently, if the setting information is received, the processor 70 turns on the crime prevention mode flag 340 in Step S5. That is, the crime prevention mode is set.

Subsequently, in Step S7, the processor 70 determines whether a warning or an alarm is being issued. That is, the processing in Step S7 is executed such that the crime prevention mode is not released in response to an operation performed on the crime prevention key 26 to terminate the warning processing or the alarm processing. If "YES" in Step S7, or equivalently, if the warning processing or the alarm processing is executed, the processor 70 performs the processing in S7 again to prevent the crime prevention mode from being released.

If "NO" in Step S7, or equivalently, if the warning processing or the alarm processing is not executed, the processor 70 determines, in Step S9, whether an operation is performed on the crime prevention key 26. That is, a determination is made whether the operation of releasing the crime prevention mode is performed. If "YES" in Step S9, or equivalently, if an operation is performed on the crime prevention key 26 in the state where the crime prevention mode is set, the processor 70 proceeds to the processing in Step S13. If "NO" in Step S9, or equivalently, if an operation is not performed on the crime prevention key 26, the processor 70 determines, in Step S11, whether release information is received. That is, a determination is made whether the release information is stored in the communication buffer 330. If "NO" in Step S11, or equivalently, if the release information is not received, the processor 70 returns to the processing in Step S7. If "YES" in Step S11, or equivalently, if the release information is received, the processor 70 turns off the crime prevention mode flag 340 in Step S13. That is, the crime prevention mode is released. Upon completion of the processing in Step S13, the processor 70 returns to the processing in Step S1.

Figure 30:
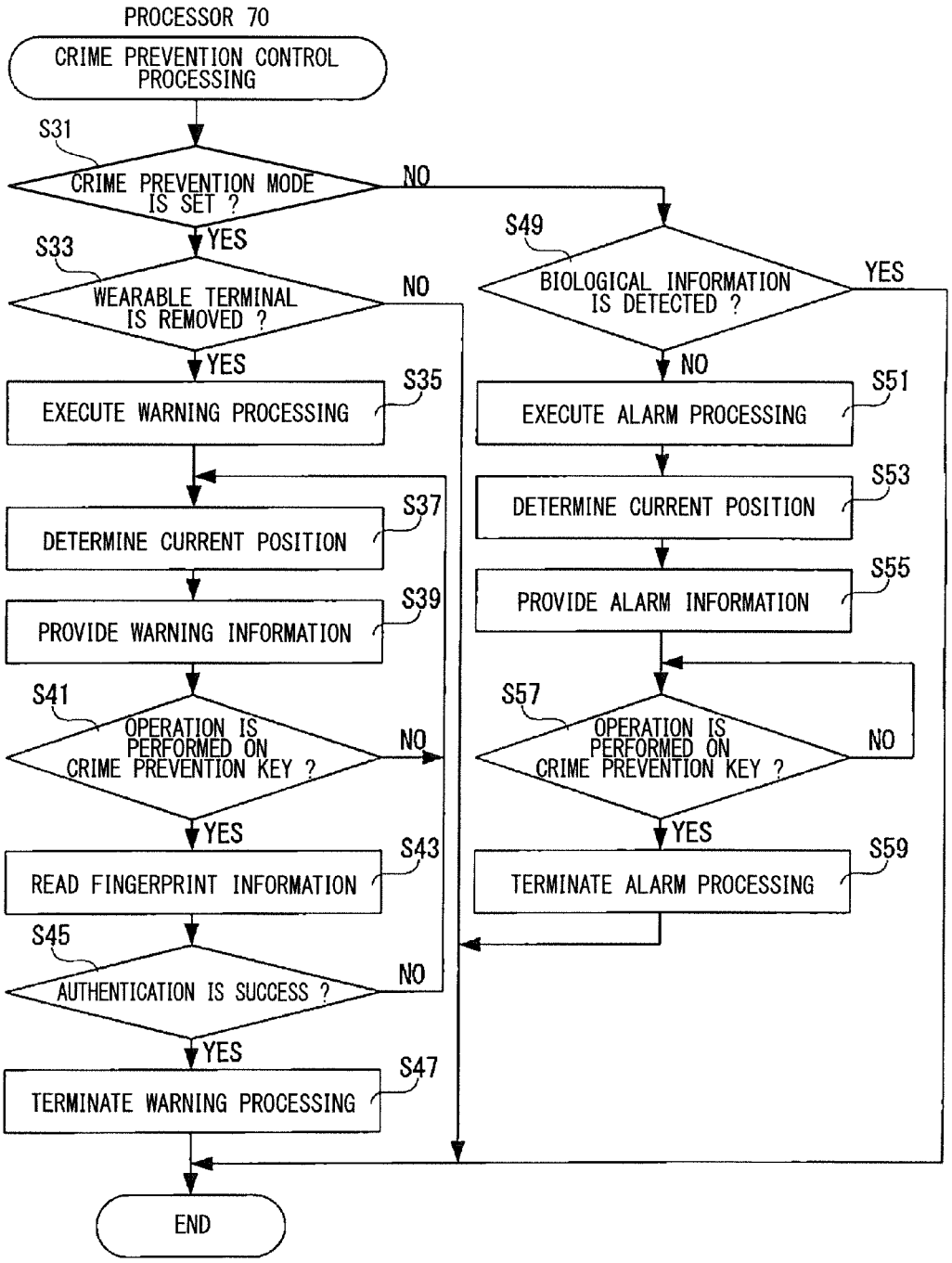
FIG. 30 illustrates a flowchart showing an example of a crime prevention control processing performed by the processor of the wearable terminal.

FIG. 30 illustrates a flowchart showing the crime prevention control processing. For example, the crime prevention control processing is executed when a command to execute the crime prevention control processing is issued. The command to execute the crime prevention control processing is issued at predetermined intervals (of, for example, one second). When the crime prevention control processing is executed, the processor 70 determines, in Step S31, whether the crime prevention mode is set. That is, a determination is made whether the crime prevention mode flag 340 is on. The processor 70 executing the processing in Step S31 functions as a specified state determination unit.

If "NO" in Step S31, or equivalently, if the crime prevention mode is not set, the processor 70 proceeds to the processing in Step S49. If "YES" in Step S31, or equivalently, if the crime prevention mode is set, the processor 70 determines, in Step S33, whether the wearable terminal 10 is removed from the child. That is, a determination is made whether the wearable terminal 10 in the crime prevention mode is removed from the child's arm. In particular, the processor 70 determines, with reference to the biological information buffer 332, whether the biosensor 32 fails to detect the biological information. The processor 70 executing the processing in Step S33 functions as a determination unit.

Figure 16:
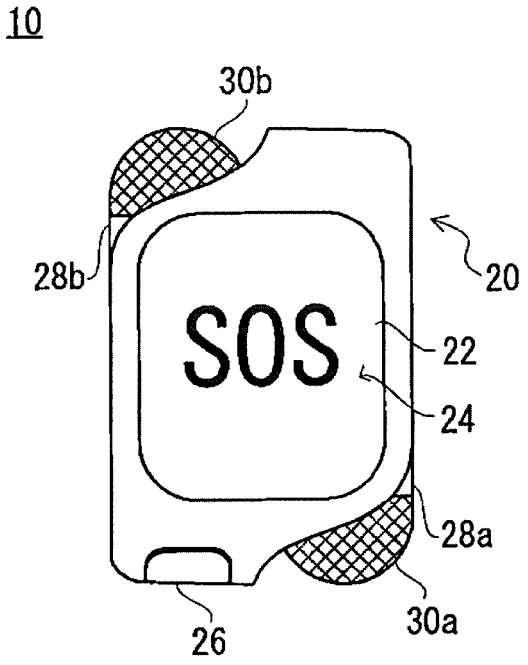
FIG. 16 illustrates a diagram showing an example of the state in which the wearable terminal executes a warning processing.

If "NO" in Step S33, or equivalently, if the wearable terminal 10 is not removed from the child, the processor 70 ends the crime prevention control processing. If "YES" in Step S33, or equivalently, if the wearable terminal 10 is removed from the child's arm, the processor 70 executes the warning processing in Step S35. That is, the display 22 of the wearable terminal 10 displays an image indicating danger, as illustrated in FIG. 16, the speaker 34 outputs a warning sound, and the LEDs 30 emit light in a warning color. The processor 70 executing the processing in Step S35 functions as a warning unit.

Subsequently, in Step S37, the processor 70 determines the current position. That is, GPS information indicating the current position of the child is computed. The processor 70 executing the processing in Step S37 functions as a position determination unit. Then, in Step S39, the processor 70 provides warning information. That is, the warning information including the current position and the removal of the wearable terminal 10 is transmitted to the mobile phone 12. The processor 70 executing the processing in Step S39 functions as a notification unit.

Subsequently, in Step S41, the processor 70 determines whether an operation is performed on the crime prevention key 26. That is, a determination is made whether the operation of terminating the warning processing is performed. The processor 70 executing the processing in Step S41 functions as an input determination unit. If "NO" in Step S41, or equivalently, if the operation of terminating the warning processing is not performed, the processor 70 returns to the processing in Step S37. In this case, the processing of determining the current position and the processing of providing the warning information are performed again. For example, in a case where the child wearing the wearable terminal 10 is abducted, the parent can keep track of the child by checking a record of warning information notifications provided to the mobile phone 12.

If "YES" in Step S41, or equivalently, if an operation is performed on the crime prevention key 26 to terminate the warning processing, the processor 70 reads fingerprint information in Step S43. That is, the fingerprint sensor included in the crime prevention key 26 reads fingerprints of the finger with which the operation is performed on the key. Subsequently, in Step S45, the processor 70 determines whether the authentication is a success. That is, a determination is made whether the fingerprint authentication processing is a success. In particular, a determination is made whether "registered fingerprint information (first release information)" included in the fingerprint information data 338 and "read fingerprint information (second release information)" stored in the fingerprint information buffer 334 are in agreement. The processor 70 executing the processing in Step S45 functions as an agreement determination unit. If "NO" in Step S45, or equivalently, in the event of a failure of the fingerprint authentication processing associated with an operation performed on the crime prevention key 26 by a stranger, the processor 70 returns to the processing in Step S37.

If "YES" in Step S45, or equivalently, in the event of a success of the fingerprint authentication processing associated with an operation performed on the crime prevention key 26 by the child, the processor 70 terminates the warning processing in Step S47. For example, the outputting of a warning sound is terminated, and the LEDs 30 emitting light in a warning color turn off. The image displayed on the display 22 disappears. Upon completion of the processing in Step S47, the processor 70 ends the crime prevention control processing. The processor 70 executing the processing in Step S47 function as a terminator.

In a case where the crime prevention mode is not set, the processor 70 determines, in Step S49, whether the biological information is detected. That is, a determination is made whether the child is in the state of emergency. If "YES" in Step S49, or equivalently, if the crime prevention mode is not set and the biological information is detected, the processor 70 ends the crime prevention control processing.

If "NO" in Step S49, or equivalently, if the biological information of the child is not detected, the processor 70 executes the alarm processing in Step S51. For example, as illustrated in FIG. 17, the display 22 displays a warning that the child is in the state of emergency, an emergency telephone number, and the like. The speaker 34 outputs a voice notifying the people around the child of the emergency state, and the LEDs 30 emit red light. The processor 70 executing the processing in Step S51 functions as an alarm unit. Subsequently, the processor 70 determines the current position in Step S53 and provides a notification of alarm information in Step S55. That is, the alarm information including the child's current position and the warning that the child is in the state of emergency is transmitted to the mobile phone 12.

Subsequently, in Step S57, the processor 70 determines whether an operation is performed on the crime prevention key 26. That is, a determination is made whether the operation of terminating the alarm processing is performed. If "NO" in Step S57, or equivalently, if an operation is not performed on the crime prevention key 26 during the execution of the alarm processing, the processor 70 executes the processing in Step S57 again. If "YES" in Step S57, or equivalently, if an operation is performed on the crime prevention key 26 during the execution of the alarm processing, the processor 70 terminates the alarm processing in Step S59. For example, the outputting of a voice indicating the state of emergency is terminated. Upon completion of the processing in Step S59, the processor 70 ends the crime prevention control processing.

In another embodiment, the fingerprint authentication processing may be also executed in terminating the alarm processing.

Figure 31:
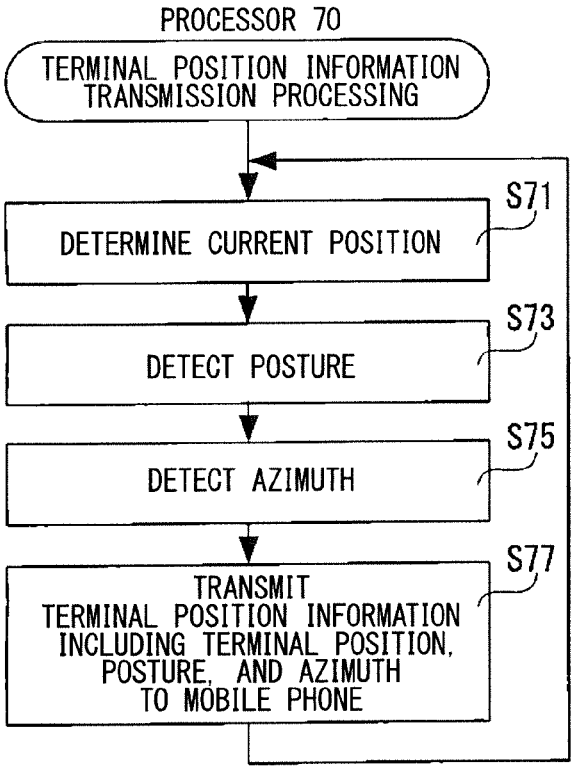
FIG. 31 illustrates a flowchart showing an example of a terminal position information transmission processing performed by the processor of the wearable terminal.

FIG. 31 illustrates a flowchart showing the terminal position information transmission processing. For example, the terminal position information transmission processing is executed when the power of the wearable terminal 10 is turned on. In Step S71, the processor 70 determines the current position. That is, the current position of the wearable terminal 10 is determined through the use of GPS signals from GPS satellites. Subsequently, in Step S73, the processor 70 detects the posture. That is, the posture of the wearable terminal 10 is detected on the basis of the output from the posture sensor 94. Then, in Step S75, the processor 70 detects the azimuth. That is, the azimuth of the wearable terminal 10 (the orientation of the child) is detected on the basis of the output from the azimuth sensor 92. The terminal position, the posture, and the azimuth are stored in the terminal position information buffer 336.

Subsequently, in Step S77, the processor 70 transmits the terminal position information including the terminal position, the posture, and the azimuth to the mobile phone 12. That is, the processor 70 creates the terminal position information including the terminal position, the posture, and the azimuth stored in the terminal position information buffer 336, and transmits the terminal position information to the mobile phone 12. Upon completion of the processing in Step S77, the processor 70 returns to the processing in Step 71. The terminal position information transmission processing is repeated at predetermined intervals (of, for example, 5 seconds).

Figure 32:
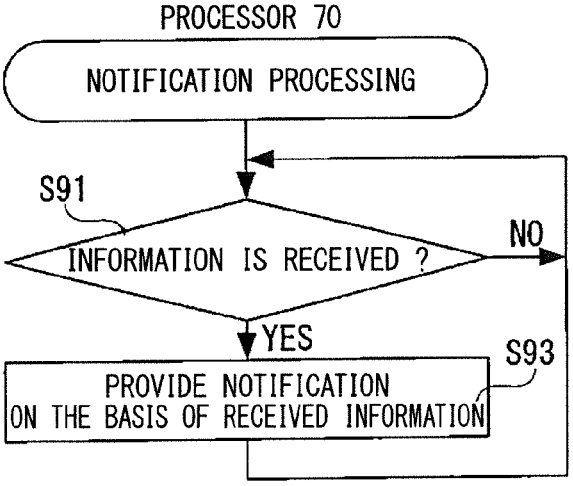
FIG. 32 illustrates a flowchart showing an example of a notification processing performed by the processor of the wearable terminal.

FIG. 32 illustrates a flowchart showing the notification processing. For example, the notification processing is executed when the power of the wearable terminal 10 is turned on. In Step S91, the processor 70 determines whether the information is received. That is, a determination is made whether the guidance information received from the mobile phone 12 is stored in the communication buffer 330. If "NO" in Step S91, or equivalently, if the guidance information is not received, the processor 70 executes the processing in Step S91 again. If "YES" in Step S91, or equivalently, if the guidance information is received, the processor 70 provides notification in Step S93 on the basis of the received information. For example, if the processor 70 receives the guidance information, the display 22 of the wearable terminal 10 displays the message advising the child to turn left with respect to the heading direction of the child and the icon indicating the left as illustrated in FIG. 24. The processor 70 causes the display 22 to display the information, and causes the wearable terminal 10 to vibrate by activating the vibrator 96. Upon completion of the processing in Step S93, the processor 70 returns to the processing in Step S91.

The processor 110 of the mobile phone 12 performs a plurality of tasks in parallel under control by a predetermined OS, namely, an OS based on Windows®, an OS based on Linux® such as Android®, or iOS®. The plurality of tasks include a terminal position information management processing in FIG. 33, a terminal management processing in FIG. 34, and a route guidance processing in FIG. 35.

Figure 33:
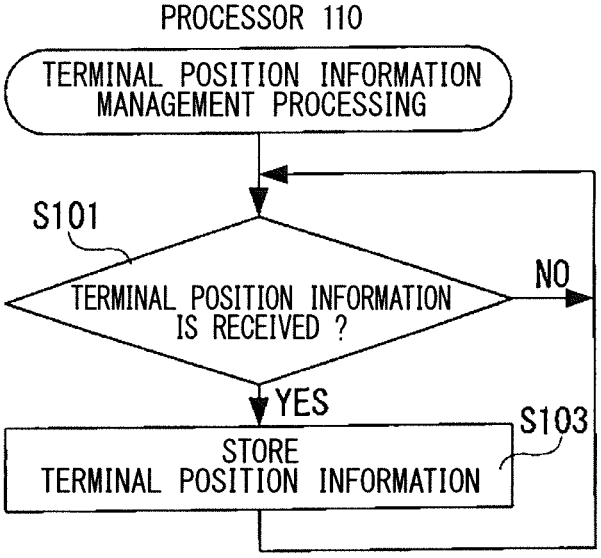
FIG. 33 illustrates a flowchart showing an example of a terminal position information management processing performed by a processor of the mobile phone.

FIG. 33 illustrates a flowchart showing the terminal position information management processing. For example, the terminal position information management processing is started when the power of the mobile phone 12 is turned on. In Step S101, the processor 110 determines whether the terminal position information is received. That is, the processor 110 determines whether the mobile phone 12 receives the terminal position information including the terminal position, the posture, and the azimuth from the wearable terminal 10. If "NO" in Step S101, or equivalently, if the terminal position information is not received from the wearable terminal 10, the processor 110 executes the processing in Step S101 again.

If "YES" in Step S101, or equivalently, if the terminal position information is received from the wearable terminal 10, the processor 110 stores the terminal position information in Step S103. That is, the received terminal position information is stored in the terminal position information buffer 432. When the processing in Step S103 is completed, the processor 110 returns to the processing in Step S101. That is, the processor 110 determines again whether the terminal position information is received. The terminal position information management processing is repeated at predetermined intervals equal to the predetermined intervals at which the terminal position information transmission processing is repeated.

Figure 34:
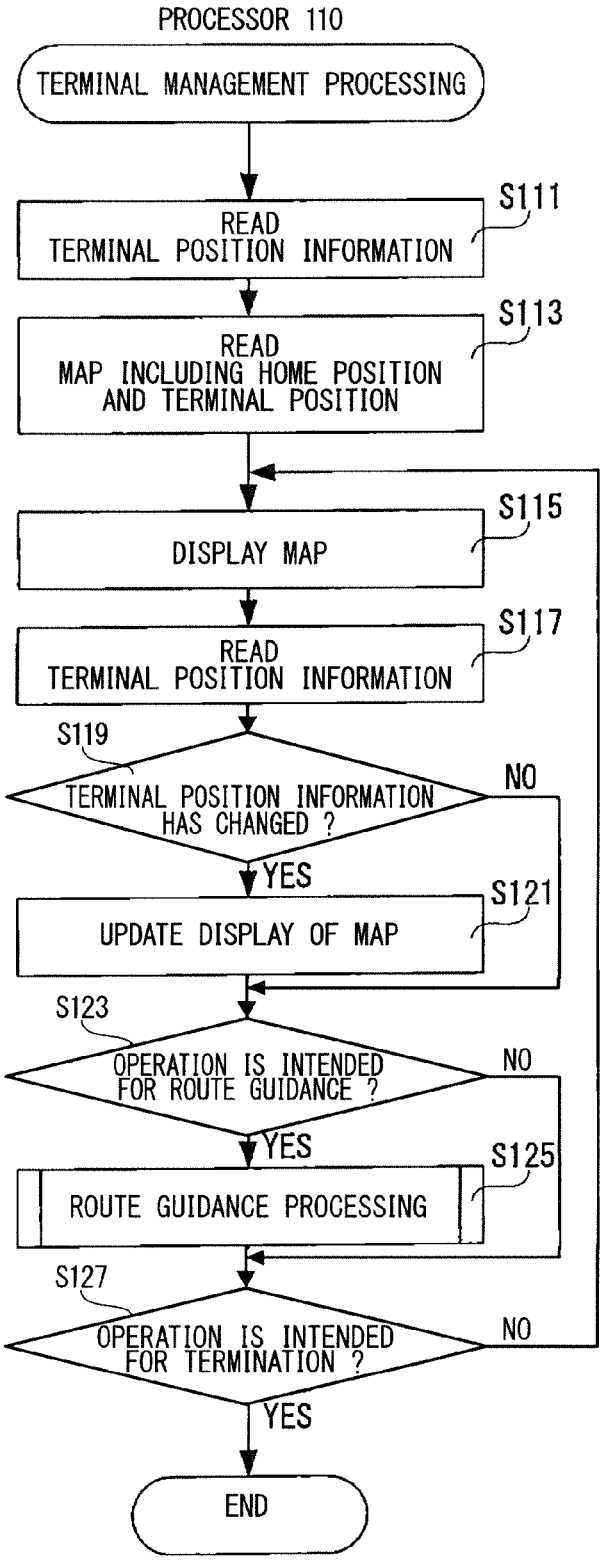
FIG. 34 illustrates a flowchart showing an example of a terminal management processing performed by the processor of the mobile phone.

FIG. 34 illustrates a flowchart showing the terminal management processing. For example, when the management function is performed in the mobile phone 12, the processor 110 reads the terminal position information in Step S111. That is, the terminal position information of the wearable terminal 10 is read from the terminal position information buffer 432. Subsequently, in Step S113, the processor 110 reads a map including the home position and the terminal position. That is, the map data 436 is read on the basis of the home position data 438 and the terminal position included in the terminal position information that has been read.

Then, in Step S115, the processor 110 causes the display 52 to display a map. For example, as illustrated in FIG. 18, the display 52 displays a map including the terminal position icon C and the home position icon H. Subsequently, in Step S117, the processor 110 reads the terminal position information. That is, the terminal position information is read from the terminal position information buffer 432 again. Then, in Step S119, the processor 110 determines whether the terminal position information has changed. For example, a determination is made whether the position of the child has changed. If "NO" in Step S119, or equivalently, if the position of the child has not changed, the processor 110 proceeds to the processing in Step S123. If "YES" in Step S119, or equivalently, if the position of the child has changed, the processor 110 updates the display of the map in Step S121. For example, the display of the terminal position icon C on the map is updated.

Subsequently, in Step S123, the processor 110 determines whether the operation is intended for the route guidance. For example, a determination is made whether a tap is performed on the terminal position icon C. If "YES" in Step S123, or equivalently, if a tap is performed on the terminal position icon C, the processor 110 executes the route guidance processing in Step S125. Upon completion of the processing in Step S125, the processor 110 proceeds to the processing in Step S127. The route guidance processing will be described in detail with reference to the flowchart in FIG. 35, and thus the detailed description thereof is not given here for brevity.

If "NO" in Step S123, or equivalently, if a tap is not performed on the terminal position icon C, the processor 110 determines whether the operation is intended for termination in Step S127. For example, a determination is made whether the operation of terminating the management function is performed on the mobile phone 12. If "NO" in Step S127, or equivalently, if the operation of terminating the management function is not performed on the mobile phone 12, the processor 110 returns to the processing in Step S115. If "YES" in Step S127, or equivalently, if the operation of terminating the management function is performed on the mobile phone 12, the processor 110 terminates the terminal management processing.

Figure 35:
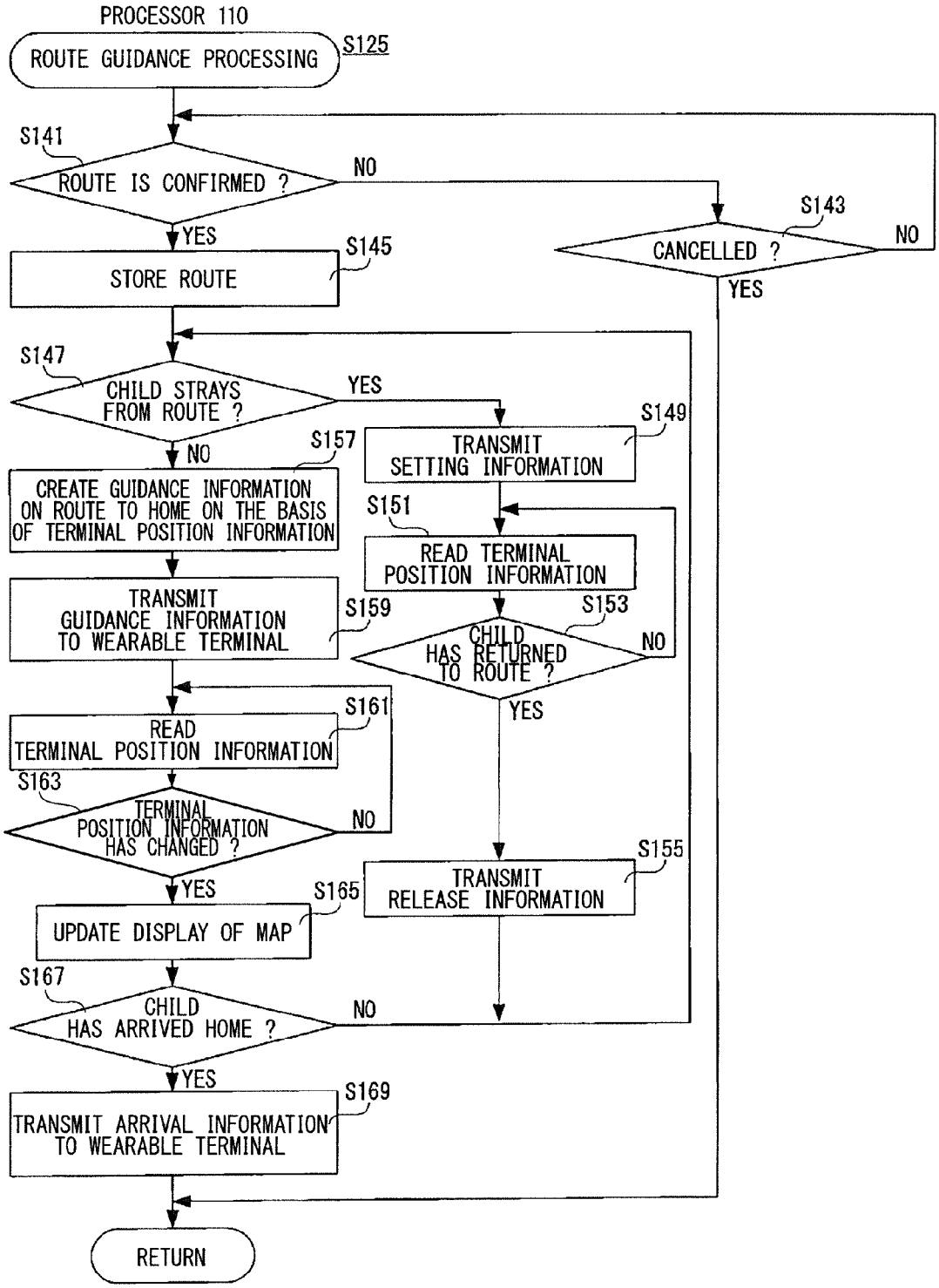
FIG. 35 illustrates a flowchart showing an example of a route guidance processing performed by the processor of the mobile phone.

FIG. 35 illustrates a flowchart showing the route guidance processing. When the processing in Step S125 is executed in the terminal management processing, the route guidance processing is started. In Step S141, the processor 110 determines whether the route is confirmed. For example, a determination is made whether a tap is performed on the home position icon H after the slide operation of inputting a route is performed as illustrated in FIGS. 19 to 22. If "NO" in Step S141, or equivalently, if the route is not confirmed, the processor 110 determines, in Step S143, whether the route is cancelled. For example, a determination is made whether no operation has been performed. If "YES" in Step S143, or equivalently, if no operation has been performed, the processor 110 terminates the route guidance processing and returns to the terminal management processing. If "NO" in Step S143, or equivalently, if a touch operation is performed on the mobile phone 12, the processor 110 returns to the processing in Step S141.

If "YES" in Step S141, or equivalently, if a route is input and then a tap is performed on the home position icon H, the processor 110 causes the RAM 126 to store a route in Step S145. If the input of the route is confirmed as illustrated in FIG. 22, the route is stored in the route buffer 434. When the route is stored, the display 52 may display the pop-up P notifying that the input route is confirmed.

Subsequently, in Step S147, the processor 110 determines whether the terminal position strays from the route. That is, a determination is made whether the current position of the child is off the route. If "YES" in Step S147, or equivalently, if the child strays from the route, the processor 110 transmits setting information in Step S149. That is, the child strays from the route, and thus, the setting information is transmitted to the wearable terminal 10 such that the crime prevention mode is set.

Subsequently, in Step S151, the processor 110 reads the terminal position information. Then, in Step S153, the processor 110 determines whether the child has returned to the route. That is, the up-to-date current position of the child is acquired, and then a determination is made whether the child has returned to the route. If "NO" in Step S153, or equivalently, if the child has not returned to the route, the processor 110 returns to the processing in Step S151. If "YES" in Step S153, or equivalently, if the child has returned to the route, the processor 110 transmits release information in Step S155. That is, the release information is transmitted to the wearable terminal 10 such that the crime prevention mode is released. Upon completion of the processing in Step S155, the processor 110 returns to the processing in Step S147.

If "NO" in Step S147, or equivalently, if the child does not stray from the route, the processor 110 creates, in Step S157, guidance information on a route to home on the basis of the terminal position information. For example, the processor 110 computes the position of the child on the route with reference to the terminal position included in the terminal position information and the route stored in the route buffer 434. Then, the processor 110 computes the right direction on the route on the basis of the posture and the azimuth included in the terminal position information. Then, the processor 110 creates the guidance information on the basis of the position and the right direction on the route that have been computed in such a manner. Subsequently, in Step S159, the processor 110 transmits the guidance information to the wearable terminal 10.

Subsequently, in Step S161, the processor 110 reads the terminal position information. Then, in Step S163, the processor 110 determines whether the terminal position information has changed. For example, a determination is made whether the position of the child has changed. If "NO" in Step S163, or equivalently, if the position of the child has not changed, the processor 110 returns to the processing in Step S161. If "YES" in Step S163, or equivalently, if the position of the child has changed, the processor 110 updates the display of the map in Step S165. For example, the display of the terminal position icon C is updated.

Subsequently, in Step S167, the processor 110 determines whether the child has arrived home. That is, a determination is made whether the terminal position is in close agreement with the home position. In particular, a determination is made whether the child has arrived home on the basis of the home position data 438 and the terminal position included in the terminal position information. If "NO" in Step S167, or equivalently, if the child has not arrived home, the processor 110 returns to the processing in Step S167.

If "YES" in Step S167, or equivalently, if the child has arrived home, the processor 110 transmits the arrival information to the wearable terminal 10 in Step S169. That is, the arrival information notifying that the child has arrived home is transmitted to the wearable terminal 10. Upon completion of the processing in Step S169, the processor 110 ends the route guidance processing and returns to the terminal management processing.

The display 52 of the mobile phone 12 may display the pop-up P providing a notification of the child's arrival in step with the transmission of the arrival information.

The state of the child's health may be managed with reference to the biological information detected by the biosensor 32. In this case, the biosensor detecting the state of the child's health can be used to determine whether the wearable terminal 10 is removed from the child. This can simplify the configuration of the wearable terminal 10.

Figure 36:
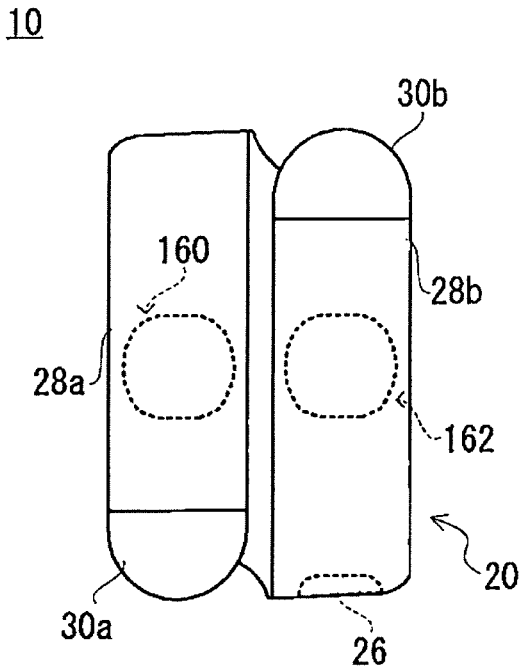
FIG. 36 illustrates a rear side of the wearable terminal having the fitted shape according to another embodiment.

In still another embodiment, without necessitating the biosensor 32, a determination may be made whether the wearable terminal 10 is removed from the child. For example, with reference to FIG. 36, a magnetic sensor 160 is embedded in the first belt 28*a* and a magnet 162 is embedded in the second belt 28*b*. This configuration allows the magnetic sensor 160 to detect the magnetism of the magnet 162 when the wearable terminal 10 has the fitted shape. In this configuration, the magnetic sensor 160 cannot detect the magnetism of the magnet 162 if the wearable terminal 10 does not have the fitted shape. This means that the magnetic sensor 160 fails to detect the magnetism of the magnet 162 when the wearable terminal 10 is taken off, and thus the processor 70 can determine that the wearable terminal 10 is taken off.

In still another embodiment, a mechanical switch, instead of the magnetic sensor 160 or the magnet 162, may be embedded in the base portion of the individual belt 28 such that the removal of the wearable terminal 10 form the child can be determined. For example, the mechanical switch embedded in the base portion of the individual belt 28 is turned off if the wearable terminal 10 has the fitted shape and the mechanical switch is turned on if the wearable terminal 10 does not have the fitted shape. Thus, the processor 70 can determine whether the wearable terminal 10 is taken off on the basis of the on-off actions of the mechanical switches.

In still another embodiment, the wearable terminal 10 may include the magnetic sensor 160 and the magnet 162 (or the mechanical switch) mentioned above as well as the biosensor 32. This allows the wearable terminal 10 to execute the alarm processing more appropriately. For example, the alarm processing is executed in the event of a biological information detection failure while it is determined, through the use of the magnetic sensor 160 and the magnet 162, that the wearable terminal 10 is not taken off.

In still another embodiment, the LEDs 30 may flash and emit light in any color while the crime prevention mode is set.

In still another embodiment, if the child strays from the route, the guidance information for bringing the child back to the route may be created and provided on the wearable terminal 10.

In still another embodiment, the parent may be notified that the mobile phone 12 fails to receive the terminal position information from the wearable terminal 10 and that the child is therefore likely to be exposed to danger.

In one embodiment, the guidance information is created in the mobile phone 12, and the route guidance based on the guidance information is provided on the wearable terminal 10. Thus, the performance of the wearable terminal 10 can be minimized, and the price of the wearable terminal 10 can be minimized accordingly. In another embodiment, the route guidance may be provided as follows: the wearable terminal 10 stores the map data; an input route is transmitted to the wearable terminal 10; and the wearable terminal 10 creates the guidance information. This configuration can lighten the workload of the mobile phone 12, and can reduce the communication traffic accordingly.

In one embodiment, the home information is registered through the use of GPS signals. In another embodiment, the home position may be set by the parent designating the home position on the displayed map.

In still another embodiment, it is not required that a map be displayed on the display 52 of the mobile phone 12 during the route guidance. In this case, a notification action is performed through the use of sound and light at the occurrence of an event, such as the child's arrival at home.

In still another embodiment, it is not required that the home be set as the destination in the route guidance. Alternatively, the current position of the mobile phone 12 may be set as the destination, or any place may be set as the destination when a route is input.

In still another embodiment, similarly to the display of the mobile phone 12, the display 22 of the wearable terminal 10 may display a map while the route guidance is provided on the wearable terminal 10.

In still another embodiment, during the route guidance, the wearable terminal 10 may provide instructions to walk with the eyes kept to the front. With an acceleration sensor being included in the wearable terminal 10, in a case where the posture sensor 94 detects the posture in which the wearable terminal 10 is checked and the acceleration sensor detects shifts in the position of the wearable terminal 10, the route guidance may be temporarily halted and a message instructing the child to stop may be displayed. If this is the case, the route guidance is resumed when no shift in the position of the wearable terminal 10 is detected.

In still another embodiment, the warning information or the alarm information may be provided (transmitted) not only to the mobile phone 12 but also to a mobile communication terminal, such as a tablet terminal or a PDA, a notebook PC, or a desktop PC.

In addition to GPS signals transmitted from the GPS satellites, signals transmitted from the base station may be used to determine the current position in still another embodiment. Alternatively, signals transmitted from wireless LAN access points may be used in place of GPS signals.

The programs implemented in one embodiment may be stored in a hard disk drive (HDD) of a data distribution server and may be distributed to the mobile phone 12 and the wearable terminal 10 through the network. Recording media including optical disks such as compact discs (CDs), DVDs, Blue-Ray Disks (BDs), USB memories, and memory cards may be sold or distributed, with a plurality of programs being stored in the recording media. The effects equal to those of one embodiment may be produced if the programs downloaded through the server or the recording media mentioned above are installed on mobile phones and wearable terminals having the configurations equivalent to the configurations of the mobile phone and the wearable terminal in one embodiment.

The specific numerical values mentioned herein are provided as merely an example, and therefore, may be appropriately changed in accordance with, for example, changes in product specifications.

While the crime prevention system 100 has been described above in detail, the above description is in all aspects illustrative and not restrictive. In addition, various modifications described above are applicable in combination as long as they are not mutually inconsistent. It is understood that numerous modifications which have not been exemplified can be devised without departing from the scope of the present disclosure.

The invention claimed is:

1. A wearable device comprising:

a case that houses at least one processor and comprises a hard key, wherein the hard key comprises a fingerprint sensor;

a belt to be fastened to a body; and the at least one processor configured to, when the hard key is pressed while the wearable device is in a non-crime-prevention mode, switch to a crime-prevention mode, and while the wearable device is in the crime-prevention mode, determine when the wearable device is removed from the body, notify another device of removal of the wearable device from the body when the wearable device is determined to have been removed from the body, and when the hard key is pressed, read a fingerprint via the fingerprint sensor, compare the read fingerprint to a registered fingerprint, and switch the wearable device to the non-crime-prevention mode when the read fingerprint matches the registered fingerprint.

2. The wearable device according to claim 1, wherein, when the wearable device is determined to have been removed from the body, the at least one processor determines a current position of the wearable device, and notifies the another device of the current position and the removal of the wearable device.

3. The wearable device according to claim 1, wherein the at least one processor is configured to, while the wearable device is in the crime prevention mode:

monitor a location of the wearable device;

determine when the location of the wearable device corresponds to a predefined geographical region; and notify the another device whenever the location of the wearable device is determined to correspond to the predefined geographical region.

4. The wearable device according to claim 1, wherein the at least one processor is configured to, while the wearable device is in the crime-prevention mode, provide a warning via the wearable device when the wearable device is determined to have been removed from the body.

5. The wearable device according to claim 1, further comprising a detector configured to detect biological information, wherein the at least one processor is configured to determine when the wearable device is removed from the body based on the detected biological information.

6. The wearable device according to claim 5, wherein the detector comprises a sensor for measuring a pulse, and wherein the biological information comprises the pulse measured by the sensor.

7. The wearable device according to claim 1, further comprising a detector configured to detect biological information, wherein the at least one processor is configured to issue an alarm indicating a state of emergency when the detector fails to detect the biological information.

8. The wearable device according to claim 7, wherein the detector comprises a sensor for measuring a pulse, and wherein the biological information comprises the pulse measured by the sensor.

9. The wearable device according to claim 1, wherein the belt comprises a first belt portion that extends from a first side of the case and comprises a first end opposite the case, and a second belt portion that extends from a second side of the case and comprises a second end opposite the case, wherein the second side is opposite the first side, wherein each of the first belt portion and the second belt portion is configured to maintain both a normal shape, in which the respective belt portion is flat, and a fitted shape, in which at least a portion of the respective belt portion is bent, and to switch between the normal shape and the fitted shape in response to a force exerted on the respective belt portion, and wherein, when both the first belt portion and the second belt portion are in the fitted shape, the first belt portion and the second belt portion are parallel, the first belt portion does not overlap the second belt portion, and the first end is not fastened to the second end.

10. The wearable device according to claim 9, wherein each of the first end of the first belt portion and the second end of the second belt portion comprises a light emitter, and wherein the at least one processor is configured to cause both light emitters to emit light in a warning color when the wearable device is determined to have been removed from the body.

11. The wearable device according to claim 1, wherein the case further comprises a display, and wherein the at least one processor is further configured to:

receive route guidance from the another device; and display a direction for following the route guidance on the display.

12. The wearable device according to claim 11, wherein the at least one processor is further configured to:

monitor a location of the wearable device; and, after receiving the route guidance from the another device, determine whether or not the location of the wearable device has strayed from the route guidance, and, automatically switch the wearable device to the crime-prevention mode when the location of the wearable device is determined to have strayed from the route guidance.

13. A non-transitory computer readable recording medium that stores a control program for causing a processor of a wearable device, comprising a belt to be fastened to a body and a hard key comprising a fingerprint sensor, to:

when the hard key is pressed while the wearable device is in a non-crime-prevention mode, switch to a crime-prevention mode; and, while the wearable device is in the crime-prevention mode, determine when the wearable device is removed from the body;

notify another device of removal of the wearable device from the body when the wearable device is determined to have been removed from the body, and, when the hard key is pressed, read a fingerprint via the fingerprint sensor, compare the read fingerprint to a registered fingerprint, and switch the wearable device to the non-crime-prevention mode when the read fingerprint matches the registered fingerprint.

14. A control method in a wearable device, comprising a belt to be fastened to a body and a hard key comprising a fingerprint sensor, the method causing a processor of the wearable device to:

when the hard key is pressed while the wearable device is in a non-crime-prevention mode, switch to a crime-prevention mode; and, while the wearable device is in the crime-prevention mode, determine when the wearable device is removed from the body;

notify another device of removal of the wearable device from the body when the wearable device is determined to have been removed from the body, and, when the hard key is pressed, read a fingerprint via the fingerprint sensor, compare the read fingerprint to a registered fingerprint, and switch the wearable device to the non-crime-prevention mode when the read fingerprint matches the registered fingerprint.

* * * * *